US010435257B2

(12) United States Patent
Morisawa et al.

(10) Patent No.: US 10,435,257 B2
(45) Date of Patent: Oct. 8, 2019

(54) SHEET PLACEMENT APPARATUS AND PRINTING APPARATUS

(71) Applicant: SEIKO EPSON CORPORATION, Tokyo (JP)

(72) Inventors: Ryoichi Morisawa, Shiojiri (JP); Katsuyuki Kondo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/847,075

(22) Filed: Dec. 19, 2017

(65) Prior Publication Data

US 2018/0179000 A1 Jun. 28, 2018

(30) Foreign Application Priority Data

Dec. 27, 2016 (JP) ..... 2016-254252

(51) Int. Cl.

| | |
|---|---|
| ***B65H 1/12*** | (2006.01) |
| ***B65H 1/04*** | (2006.01) |
| ***B65H 5/06*** | (2006.01) |
| ***B41J 11/00*** | (2006.01) |
| ***B65H 3/06*** | (2006.01) |

(52) U.S. Cl.

CPC ..... *B65H 1/12* (2013.01); *B41J 11/007* (2013.01); *B65H 1/04* (2013.01); *B65H 3/06* (2013.01); *B65H 5/062* (2013.01); *B65H 2402/54* (2013.01); *B65H 2405/1117* (2013.01); *B65H 2511/12* (2013.01); *B65H 2801/03* (2013.01)

(58) Field of Classification Search

CPC .... B65H 1/08; B65H 1/12; B65H 2402/5151; B65H 2402/54; B65H 2402/542; B65H 2402/543; B65H 2405/11162; B65H 2405/1117; B65H 2405/11172; B65H 2511/12; B65H 2701/1131

See application file for complete search history.

(56) References Cited

U.S. PATENT DOCUMENTS

| | | | | |
|---|---|---|---|---|
| 4,007,925 | A * | 2/1977 | DeRyke | B65H 1/12 271/126 |
| 4,623,137 | A * | 11/1986 | Irie | B65H 1/04 271/127 |
| 6,182,963 | B1 * | 2/2001 | Yergenson | B65H 1/12 271/127 |
| 8,353,508 | B2 * | 1/2013 | Nishikata | B65H 1/12 271/147 |
| 2014/0367908 | A1 * | 12/2014 | Sawada | B65H 1/12 271/160 |
| 2018/0178560 | A1 * | 6/2018 | Okawa | B65H 1/12 |

FOREIGN PATENT DOCUMENTS

| | | |
|---|---|---|
| JP | 2004-331345 | 11/2004 |

* cited by examiner

*Primary Examiner* — Ernesto A Suarez
(74) *Attorney, Agent, or Firm* — Workman Nydegger

(57) ABSTRACT

Provided is a sheet placement apparatus that is capable of changing the force of pushing a hopper configured to push up a sheet, without an increase in size, and a printing apparatus that is equipped with such a sheet placement apparatus.

17 Claims, 14 Drawing Sheets

SHEET PLACEMENT APPARATUS AND PRINTING APPARATUS

CROSS REFERENCES TO RELATED APPLICATIONS

The entire disclosure of Japanese Patent Application No.: 2016-254252, filed Dec. 27, 2016 is expressly incorporated by reference herein.

BACKGROUND

1. Technical Field

The present invention relates to a sheet placement apparatus in which a sheet such as paper is to be placed, and a printing apparatus such as a printer equipped with a sheet placement apparatus.

2. Related Art

In related art, as one example of a printing apparatus, a printer that forms an image by feeding one sheet after another exists. Some of such printers are equipped with a paper feeding cassette (sheet placement apparatus) on which plural sheets are stacked (for example, see JP-A-2004-331345).

The paper feeding cassette includes an inner plate (hopper), which pushes up stacked sheets toward a paper feeding roller, and a pair of side restriction plates (guide portions) for restricting the position of the sheets in the width direction. The force of pushing up the sheets by the inner plate is changed depending on the position of the side restriction plates.

The paper feeding cassette includes a plurality of springs (urging member (pushing member)) for urging (pushing) the inner plate, and further includes a lock member that is capable of locking, among the plurality of springs, one spring that is located at the center in the width direction in a contracted state (i.e., non-urging state, in which the inner plate is not urged). When the two side restriction plates are moved closer to each other in a state in which the inner plate has been pushed down against the urging force of the springs, the lock member slides in the direction orthogonal to the direction of movement of the side restriction plates to come into engagement with the one spring located at the center, thereby locking the spring in a non-urging state.

Therefore, in the paper feeding cassette, when the spring is switched between an urging state (pushing state) and a non-urging state (non-pushing state), a space for slide movement of the lock member in relation to the spring is required in the direction orthogonal to the direction of movement of the side restriction plates, that is, to the direction of the width of the stacked sheets, resulting in an increase in size.

The problem described above is not limited to printers equipped with a paper feeding cassette. The same problem applies to various printing apparatuses equipped with a sheet placement apparatus.

SUMMARY

An advantage of some aspects of the invention is to provide a sheet placement apparatus that is capable of changing the force of urging a hopper configured to push up a sheet, without an increase in size, and a printing apparatus that is equipped with such a sheet placement apparatus.

Solving means according to some aspects, and operational effects thereof, are described below.

A sheet placement apparatus according to one aspect comprises: a placement portion on which a sheet is able to be placed; a hopper that pushes up the sheet off a bottom of the placement portion by moving away from the bottom inside the placement portion; a pushing member that pushes the hopper away from the bottom; a switching portion that switches the pushing member between a pushing state, in which the hopper is pushed, and a non-pushing state, in which the hopper is not pushed, the switching portion including a position change member that is fixed to the pushing member in such a way as to be able to change position due to deformation of the pushing member, is in contact with the hopper from a bottom side when the pushing member is in the pushing state, and is located away from the hopper toward the bottom when the pushing member is in the non-pushing state, and a restricting portion that is provided at a position that is, in the placement portion, closer to the bottom than the hopper is and is on a path of position change of the position change member, is configured to allow the position change member to change position toward the hopper on a basis of a pushing force of the pushing member when the position change member is not in contact, and is configured to restrict position change of the position change member toward the hopper against the pushing force of the pushing member when the position change member is in contact; wherein either one, the position change member or the restricting portion, is able to rotate relatively to the other on a shaft portion, which intersects with the bottom in a vertical direction, and wherein rotation of the either one causes a switching between the pushing state, in which the position change member is not in contact with the restricting portion, and the non-pushing state, in which the position change member is in contact with the restricting portion.

The switching portion realizes switching between a pushing state, in which the hopper is pushed, and a non-pushing state, in which the hopper is not pushed, without requiring a space for sliding movement, by causing either one, the position change member or the restricting portion, to rotate on the shaft portion between a contact position where the one is in contact with the other and a non-contact position where the one is not in contact with the other. Therefore, with this structure, it is possible to change the force of pushing the hopper configured to push up sheets without an increase in size.

In the above sheet placement apparatus, the following structure is preferable: on the placement portion, a pair of guide portions for determining a position of the placed sheet in a width direction intersecting with a feed direction, in which the sheet is fed from the placement portion, is provided in such a way as to be able to move in relation to each other in the width direction, and the pushing member is provided at each of a plurality of positions in the width direction; the switching portion is able to switch, among the plurality of pushing members, the pushing member that is provided at a center area in the width direction between the pushing state and the non-pushing state; the either one of the position change member and the restricting portion rotates when driven by relative movement of the pair of guide portions in the width direction; and the pushing member is switched from the pushing state to the non-pushing state in a case where the pair of guide portions is moved relatively to each other in such a way as to decrease a distance therebetween in the width direction.

When the space between the pair of guide portions is decreased in accordance with sheets that are small in size in the width direction, among the plurality of pushing members provided at respective positions in the width direction, the state of the pushing member provided at the center area is switched from a pushing state to a non-pushing state. Therefore, with this structure, it is possible to make the force of pushing the hopper smaller when sheets that are small in size are placed.

In the above sheet placement apparatus, the following structure is preferable: each of the pair of guide portions includes a transmission portion that extends toward the center in the width direction; each of the transmission portions has a rack that is in meshing engagement with a pinion provided at the center area in the width direction, with the pinion engaged between the respective transmission portions of the pair of guide portions; as one of the two transmission portions of the pair of guide portions, a transmission portion that is located at a position closer to the switching portion has a protruding portion that protrudes toward the switching portion at an opposite side that is opposite of a side that has the rack; the protruding portion includes a first contact portion, which is located at a leading side of the one transmission portion on which the protruding portion is formed, and a second contact portion, which is located at a base side of the one transmission portion; the switching portion includes a third contact portion, with which the first contact portion comes into contact in a case where the pair of guide portions is moved relatively to each other in such a way as to decrease the distance therebetween in the width direction, and a fourth contact portion, with which the second contact portion comes into contact in a case where the pair of guide portions is moved relatively to each other in such a way as to increase the distance therebetween in the width direction; pushing contact of the first contact portion with the third contact portion causes the either one of the position change member and the restricting portion of the switching portion to rotate in a first direction, thereby switching the pushing member from the pushing state to the non-pushing state; and pushing contact of the second contact portion with the fourth contact portion causes the either one of the position change member and the restricting portion of the switching portion to rotate in a second direction that is opposite of the first direction, thereby switching the pushing member from the non-pushing state to the pushing state.

When the two guide portions are moved relatively to each other in such a way as to decrease the distance therebetween in the width direction, the first contact portion of the protruding portion, which protrudes from the transmission portion toward the switching portion, comes into contact with the third contact portion of the switching portion to cause either the position change member or the restricting portion to rotate in the first direction, thereby switching the state of the pushing member to a non-pushing state. When the two guide portions are moved relatively to each other in such a way as to increase the distance therebetween in the width direction, the second contact portion of the protruding portion, which protrudes from the transmission portion toward the switching portion, comes into contact with the fourth contact portion of the switching portion to cause either the position change member or the restricting portion to rotate in the second direction, thereby switching the state of the pushing member to a pushing state. Therefore, with this structure, it is possible to easily switch the state of the pushing member configured to push the hopper between a pushing state and a non-pushing state by moving the guide portions relatively to each other in accordance with the size of sheets placed.

In the above sheet placement apparatus, the following structure is preferable: the position change member has an extended portion, which protrudes outward in a radial direction beyond a virtual circle having the center at the shaft portion, and a recessed portion, which is recessed inward in the radial direction in such a way as not to go beyond the virtual circle, and the recessed portion has a size that is large enough to pass through the restricting portion; the extended portion has a fifth contact portion facing the hopper from the bottom side; the restricting portion has a sixth contact portion, with which the fifth contact portion is able to come into contact from the bottom side; when the either one of the position change member and the restricting portion rotates, the pushing member is switched to the non-pushing state in a case where the fifth contact portion is at a position of coming into contact with the sixth contact portion from the bottom side or to the pushing state in a case where the restricting portion allows the recessed portion to pass thereat.

The switching portion is able to put the pushing member into a non-pushing state by causing either one, the position change member or the restricting portion, to rotate so as to bring the fifth contact portion of the extended portion of the position change member into contact with the sixth contact portion of the restricting portion from the bottom side, and is able to put the pushing member into a pushing state by rotation to a position where the restricting portion allows the recessed portion of the position change member to pass. Therefore, with this structure, it is possible to easily switch the state of the pushing member configured to push the hopper between a pushing state and a non-pushing state by causing either the position change member or the restricting portion to rotate.

In the above sheet placement apparatus, the following structure is preferable: at least one of the fifth contact portion and the sixth contact portion has a non-slip structure for preventing the fifth contact portion and the sixth contact portion from slipping in relation to each other when the fifth contact portion and the sixth contact portion are in contact with each other.

With this structure, it is possible to make the fifth contact portion and the sixth contact portion less slippery in relation to each other when the fifth contact portion of the extended portion of the position change member is in contact with the sixth contact portion of the restricting portion from the bottom side and when the pushing member is therefore in a non-pushing state. Therefore, it is possible to reduce the risk that the fifth contact portion and the sixth contact portion might be brought out of contact with each other due to the effect of, for example, vibration.

In the above sheet placement apparatus, the following structure is preferable: when the pushing member is in the pushing state and when the position change member is in contact with the hopper from the bottom side, the hopper is able to cause the position change member to move to the side closer to the bottom than the restricting portion by producing downward movement against the pushing force of the pushing member; and the guide portions for determining the position of the sheet placed on the placement portion in the width direction intersecting with the feed direction, in which the sheet is fed from the placement portion, move in the width direction in a state in which the position change member is located closer to the bottom than the restricting portion.

For example, in a case where the pushing member is in a non-pushing state and where the position change member is in contact with the restricting portion, when the guide portions are moved from this state to cause either the position change member or the restricting portion to rotate, the position change member is pushed down by the hopper away from the restricting portion. Therefore, with this structure, it is possible to easily switch the state of the pushing member configured to push the hopper between a pushing state and a non-pushing state by performing an operation of moving the guide portions.

In the above sheet placement apparatus, the following structure is preferable: of the switching portion, which includes the position change member and the restricting portion, the restricting portion is provided in a fixed manner, and the position change member is able to rotate on the shaft portion; either the hopper or the position change member has a convex portion protruding toward the other, and the other has a pair of concave portions that is able to come into engagement with the convex portion; each of the convex portion and the concave portion has a slope, and, when the convex portion and the concave portion are in a state of imperfect engagement with each other, the slopes slide relatively to each other to cause the position change member to rotate in a direction of bringing the state of imperfect engagement into perfection on the basis of the pushing force of the pushing member; the pair of concave portions includes a first concave portion and a second concave portion arranged adjacent to each other in a direction of rotation of the position change member; the convex portion is engaged with the second concave portion when the pushing member is in the non-pushing state and when the position change member is in contact with the restricting portion from the bottom side; and the convex portion is engaged with the first concave portion when the pushing member is in the pushing state and when the position change member is in contact with the hopper from the bottom side.

In a structure of switching the state of the pushing member between a pushing state and a non-pushing state by means of the rotation of the position change member of the switching portion, the rotation phase of the position change member is properly kept due to engagement of the convex portion, which either the hopper or the position change member has, and the concave portion, which the other of the two has. If the convex portion of the one and the concave portion of the other are in a state of imperfect engagement with each other, there is a risk that the imperfection might disrupt the rotation phase of the position change member. Such a risk should be avoided. In this structure, when the convex portion and the concave portion are in a state of imperfect engagement with each other, the slope of the convex portion and the slope of the concave portion slide relatively to each other to cause the position change member to rotate in a direction of bringing the state of imperfect engagement into perfection by means of the pushing force of the pushing member. It is possible to put the pushing member into a non-pushing state, with the contact of the position change member with the restricting portion, in a case where the convex portion comes into engagement with the second concave portion. It is possible to put the pushing member into a pushing state and push the hopper in a case where the convex portion comes into engagement with the first concave portion.

In the above sheet placement apparatus, the following structure is preferable: the hopper has a holding portion, which is capable of holding the position change member that is in contact from the bottom side; and the holding portion restricts movement of the position change member in the feed direction and the width direction.

Since the holding portion of the hopper restricts the movement of the position change member of the switching portion in the feed direction and the width direction, with this structure, it is possible to make the change in position of the position change member stable in the direction of pushing by the pushing member.

A printing apparatus according to another aspect comprises: the sheet placement apparatus; a feeder unit that feeds the sheet placed in the sheet placement apparatus; and a printing unit that performs printing on the sheet.

With this structure, the same effects as those of the sheet placement apparatus described above can be expected.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a printing apparatus according to an exemplary embodiment will now be explained. The printing apparatus is, for example, an ink-jet printer that performs printing (recording) by ejecting ink that is an example of liquid onto a sheet such as paper.

Figure 1:
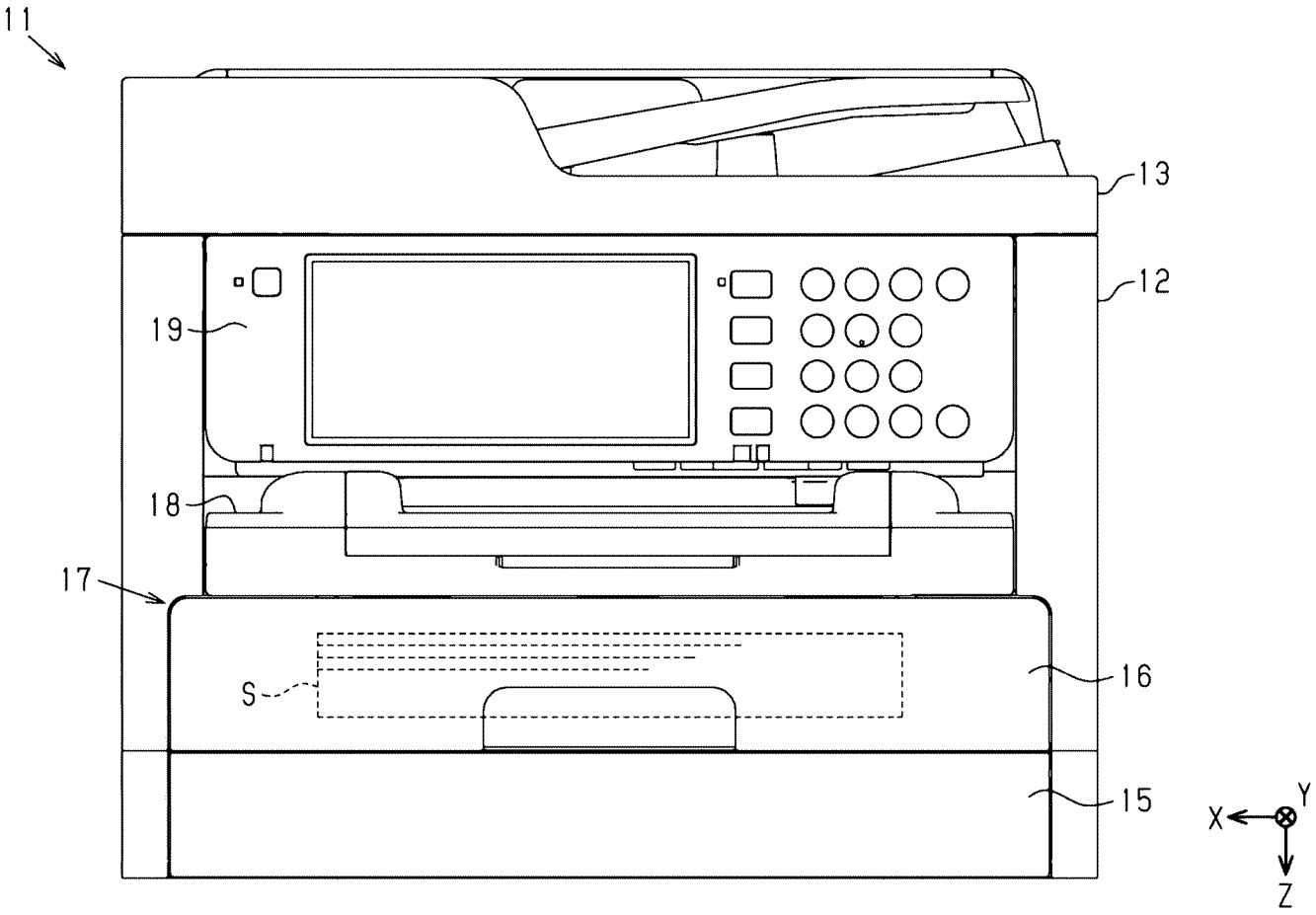
FIG. 1 is a front view of a printing apparatus according to an exemplary embodiment.

As illustrated in FIG. 1, a printing apparatus 11 includes an apparatus body 12, the shape of which is a rectangular parallelepiped. A reader unit 13, which is capable of reading an image such as characters or a photo on a document, is provided on the top of the apparatus body 12.

A front cover 15, an attachment portion 17, into which a sheet placement apparatus 16 is attached, and an ejection tray 18, onto which a printed sheet S is ejected, are provided in this order as viewed from the bottom toward the top in the front portion of the apparatus body 12. An operation panel 19 for operating the printing apparatus 11 is provided above the ejection tray 18. The front of the apparatus body 12 means a facade face that has its height and width and is used mainly for giving an operation instruction to the printing apparatus 11.

The sheet placement apparatus 16 is detachably attached to the apparatus body 12 through the front of the apparatus body 12. In the present embodiment, the direction intersecting with (preferably, orthogonal to) the path of movement for attachment of the sheet placement apparatus 16 is the width direction. The direction in which the path of movement goes is the depth direction. The width direction and the depth direction are substantially along a horizontal plane. In the drawings, under an assumption that the printing apparatus 11 is installed on a level surface, the Z axis represents the direction of gravity, and the Y axis represents the depth direction, specifically, the direction of movement when the sheet placement apparatus 16 is attached. The X axis, which is orthogonal to the Z axis and the Y axis, represents the width direction. That is, the width direction, the gravity direction, and the depth direction intersect with (preferably, are orthogonal to) one another.

Figure 2:
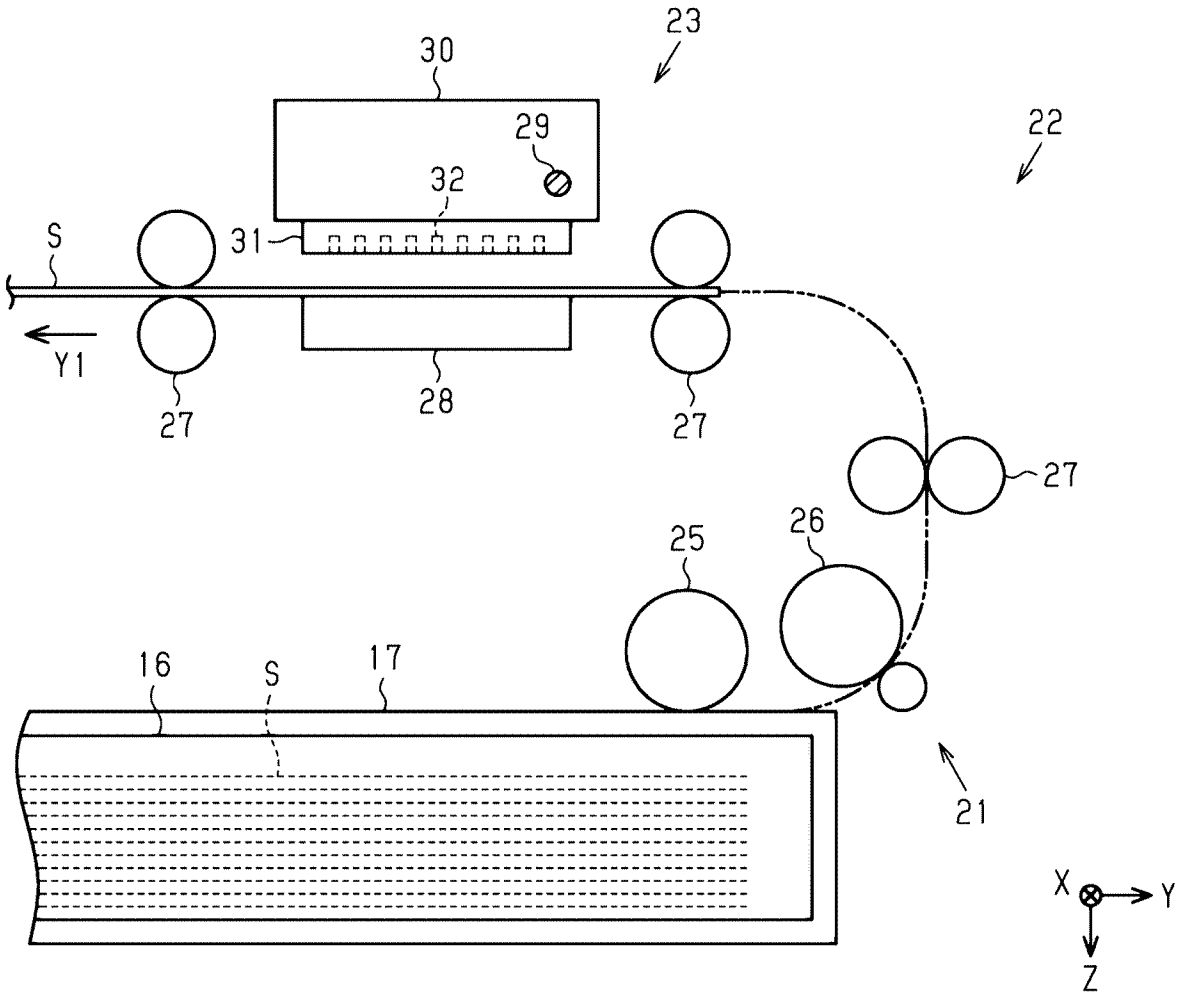
FIG. 2 is a schematic side view of the inner structure of the printing apparatus.

As illustrated in FIG. 2, a feeder unit 21 for feeding each sheet S placed (stacked) in the sheet placement apparatus 16, a transportation unit 22 for transporting the fed sheet S, and a printing unit 23 for performing printing on the transported sheet S are provided inside the apparatus body 12.

The feeder unit 21 is provided on the far side (rear in the depth direction) of the attachment portion 17. The feeder unit 21 is provided with a pickup roller 25 and separation rollers 26. The pickup roller 25 feeds out the top sheet S among sheets S loaded in a stacked state in the sheet placement apparatus 16. For sheets fed out by the pickup roller 25, the separation rollers 26 perform sheet separation processing so that a single sheet will be sent out each time.

The transportation unit 22 is provided with at least one pair of transportation rollers 27 (in FIG. 2, three pairs) for transporting the sheet S along a transportation path indicated by a dot-dot-dash line in FIG. 2. The transportation unit 22 transports the sheet S from the stack in the sheet placement apparatus 16, which is located at the upstream side in the transportation direction Y1, toward the ejection tray 18 (see FIG. 1), which is located at the downstream side in the transportation direction Y1. A supporting unit 28 for supporting the sheet S is provided on the transportation path, along which the sheet S is transported.

The printing unit 23 is provided at a position where it faces the supporting unit 28. The transportation path goes through the area between these two units facing each other. The printing unit 23 is provided with a carriage 30, which is supported by a guide shaft 29 and is able to perform reciprocating movement in the scan direction (width direction), and a print head 31, which is mounted on the carriage 30. The print head 31 performs printing by ejecting liquid (for example, ink) from nozzles 32 onto the sheet S supported by the supporting unit 28.

Next, the sheet placement apparatus 16 will now be explained.

Figure 3:
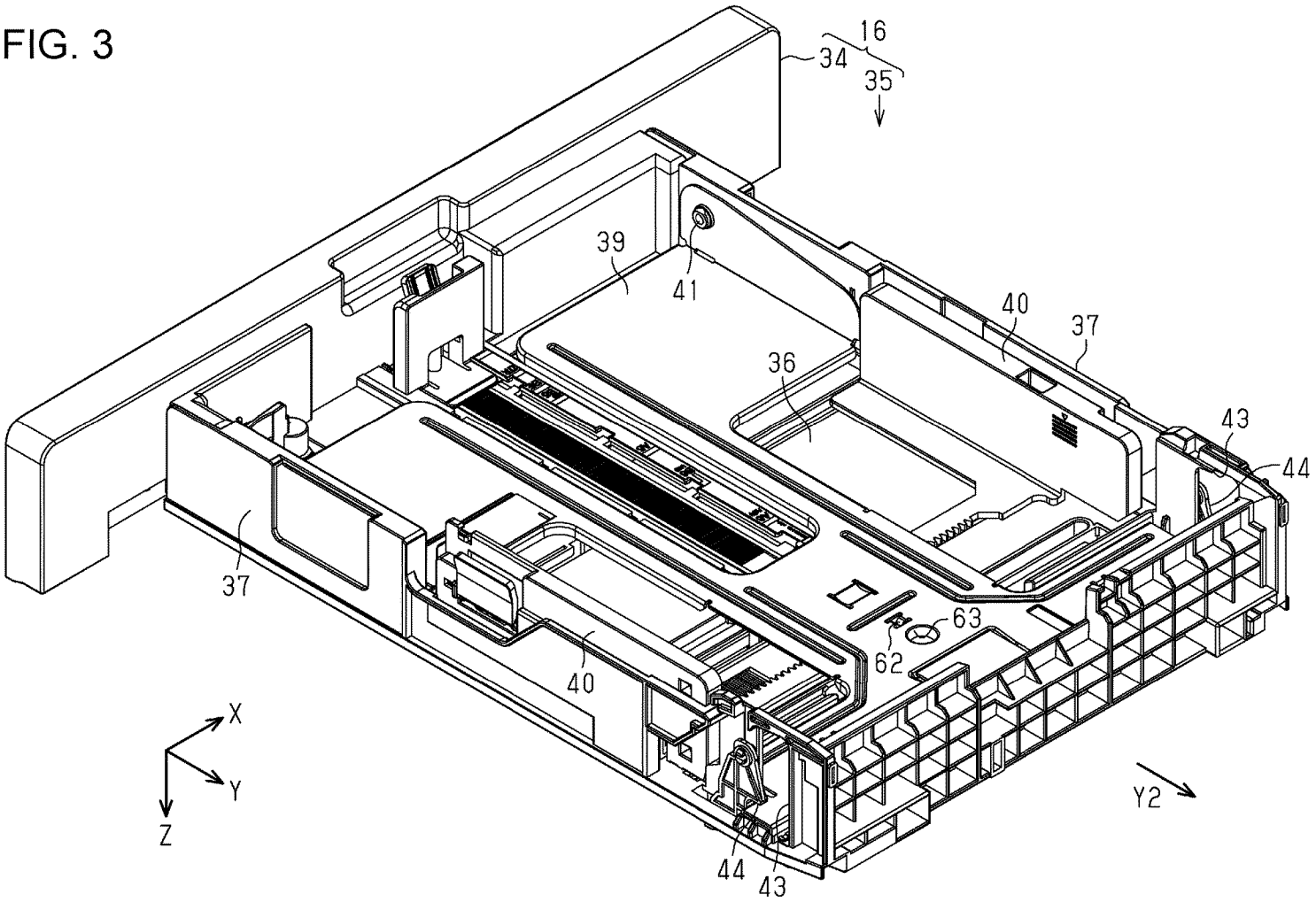
FIG. 3 is a perspective view of a sheet placement apparatus.

As illustrated in FIG. 3, the sheet placement apparatus 16 is provided with a front panel 34, which constitutes a part of the front of the apparatus body 12, and a placement portion 35, on which a stack of sheets S can be placed. The placement portion 35 has a shape like an open-topped box. The placement portion 35 is provided with a bottom plate (the bottom of the placement portion) 36, which has a substantially rectangular shape, and a pair of side plates 37 going up respectively from the two side ends of the bottom plate 36 in the width direction. The surface of the bottom plate 36 functions as a placement surface, on which sheets S can be stacked.

On the placement portion 35, a hopper 39 and a pair of guide portions 40 are provided. The hopper 39 is capable of pushing up the sheets S stacked thereon away from the bottom plate 36. There is a space between the guide portions 40 in the width direction. The hopper 39 has a plate shape. The hopper 39 is configured to be able to rotate (that is, able to pivot up and down) on a supporting shaft 41, which is provided at a front end position in the depth direction. The rear portion of the hopper 39 is lifted up by an urging member 42 (see FIG. 4), for example, a spring, which is configured to apply an urging force upward at the far side in the depth direction. The hopper 39 pushes up the sheets S off the bottom plate 36 by moving away from the bottom plate 36 inside the placement portion 35.

The leading edge of the stack of sheets S on the placement portion 35 is lifted up by the hopper 39 and is pressed against the pickup roller 25. Then, the sheet S lifted up by the hopper 39 is fed onto the transportation path by the feeder unit 21. The direction in which the sheet S is fed by the feeder unit 21 is defined as a feed direction Y2.

An opening 43, which has a substantially rectangular shape in side view, is provided at a rear position of each of the pair of side plates 37. An anchoring latch 44, which is to be latched onto the hopper 39, extends from the opening 43 of each of the pair of side plates 37. The anchoring latch 44 is configured to be able to pivot on its upper end. The hopper 39 pushed down against the urging force of the urging member 42 (see FIG. 4) is anchored at the pushed-down position by the anchoring latch 44. The anchoring latch 44 pivots to release the hopper 38 when the sheet placement apparatus 16 is attached to the apparatus body 12.

Figure 4:
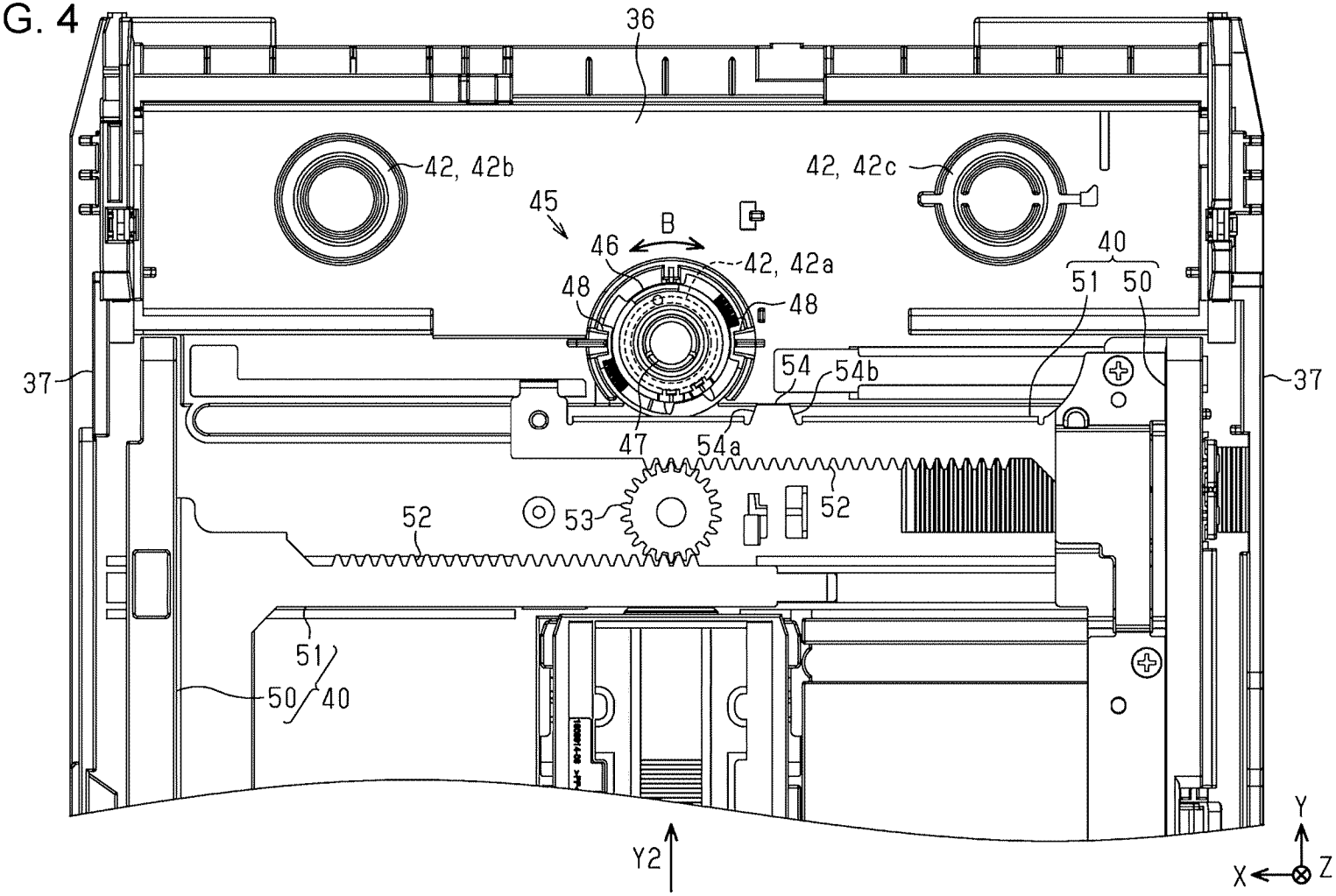
FIG. 4 is a partial plan view of the sheet placement apparatus, wherein the illustration of a hopper is omitted.

As illustrated in FIG. 4, the sheet placement apparatus 16 is provided with at least one urging member 42 (in the present embodiment, a plurality of urging members) configured to urge the hopper 39 (not illustrated in FIG. 4) away from the bottom plate 36. The urging member 42 is, for example, a coil spring that expands and contracts vertically. The urging member 42 is provided at each of a plurality of positions in the width direction. In the present embodiment, three urging members 42 are provided at intervals from one another between the hopper 39 and the bottom plate 36. Specifically, a first urging member 42*a* is provided at a center area in the width direction. A second urging member 42*b* is provided at a position closer to one side plate 37 than the first urging member 42*a* is. A third urging member 42*c* is provided at a position closer to the other side plate 37 than the first urging member 42*a* is. The center area in the width direction means an area that includes the center position between the pair of guide portions 40 (edge guides 50); in other words, the center area in the width direction is closer to the center position than, among the plurality of urging members 42, the urging member 42 that is located closest to a side end. In the present embodiment, the second urging member 42*b* and the third urging member 42*c* are located at the positions of equal distance from the center position in the width direction, and, in addition, the area between the second urging member 42*b* and the third urging member 42*c* is the center area. In the present embodiment, the center of the first urging member 42*a* in top view coincides with the center position.

The sheet placement apparatus 16 is provided with a switching portion 45 for switching the first urging member 42*a* between an urging state and a non-urging state. The term "urging state" means a state in which the hopper 39 is urged by the first urging member 42*a* and in which the functioning of the first urging member 42*a* onto the hopper 39 is enabled. The term "non-urging state" means a state in which the hopper 39 is not urged by the first urging member 42*a* and in which the functioning of the first urging member 42*a* onto the hopper 39 is disabled.

The switching portion 45 includes a position change member 46, which is fixed to the first urging member 42*a* in such a way as to be able to change its position due to the deformation of the first urging member 42*a*. The position change member 46 is in contact with the hopper 39 from the bottom-plate side 36 when the first urging member 42*a* is in an urging state. The position change member 46 is located away from the hopper 39 toward the bottom plate 36 when the first urging member 42*a* is in a non-urging state. The position change member 46 of the present embodiment has a substantially cylindrical shape and is able to rotate on a cylindrical shaft portion 47, which is provided on the bottom plate 36.

The switching portion 45 includes a restricting portion 48, which is provided in a fixed manner on the bottom plate 36 and restricts the movement of the position change member 46 in a direction in which the first urging member 42*a* urges the position change member 46 (upward). The restricting portion 48 is provided at a position that is, in the placement portion 35, closer to the bottom plate 36 than the hopper 39 is and is on a path of position change of the position change member 46. The restricting portion 48 allows the position change member 46 to change its position toward the hopper 39 on the basis of the urging force of the first urging member 42*a* when the position change member 46 is not in contact. The restricting portion 48 restricts a change in position of the position change member 46 toward the hopper 39 against the urging force of the first urging member 42*a* when the position change member 46 is in contact.

The shaft portion 47 protrudes from the bottom plate 36. The shaft direction of the shaft portion 47 is the same as the gravity direction. The restricting portion 48 is provided as a pair at a circumferential distance from each other in the direction B of the circumference of the shaft portion 47 in such a manner that the shaft portion 47 is interposed therebetween in the direction A of the diameter of the shaft portion 47 (see FIG. 6, in the width direction in the present embodiment). The radial direction A and the circumferential direction B are different from each other. The radial direction A and the circumferential direction B are different from the shaft direction of the shaft portion 47. The radial direction A and the circumferential direction B of the present embodiment are directions going along a horizontal plane.

Next, the guide portions 40 will now be explained.

As illustrated in FIG. 4, the pair of guide portions 40 determines the position of the sheets S on the placement portion 35 in the width direction intersecting with the feed direction Y2, in which the sheet S is fed from the placement portion 35. The pair of guide portions 40 is movable in relation to each other in the width direction. For guiding the sheet S, the guide portions 40 are moved in the width direction, which is different from (preferably, orthogonal to) the feed direction Y. Specifically, each of the pair of guide portions 40 includes an edge guide 50, which is configured to guide a width-directional side edge of the sheet S, and a transmission portion 51, which is connected to the edge guide 50 and extends in the width direction. Each of the pair of transmission portions 51 extends from the corresponding one of edge guides 50 toward the center in the width direction. Each of the pair of transmission portions 51 has a rack 52. The rack 52 of one of the pair of transmission portions 51 and the rack 52 of the other face each other. A pinion 53, which is in meshing engagement with both of the two racks 52, is provided at an inside position between the two racks 52. That is, each of the two transmission portions 51 has the rack 52 that is in meshing engagement with the pinion 53 provided at the center area in the width direction, with the pinion 53 engaged between the respective transmission portions 51 of the pair of guide portions 40. Therefore, when either one of the two guide portions 40 is moved in the width direction, the movement causes the other guide portion 40 also to move. Specifically, the two guide portions 40 move toward each other or away from each other.

One of the two transmission portions 51 of the pair of guide portions 40, specifically, the rear one (transmission portion 51) located at a position closer to the switching portion 45 (closer to the position change member 46), has a protruding portion 54. The protruding portion 54 is a bulge formed toward the switching portion 45 at an opposite side that is the opposite of the side that has the rack 52. The protruding portion 54 moves in the width direction when the edge guide 50 moves. A part of the movement area of the protruding portion 54 coincides with a part of the rotation area of the position change member 46. Therefore, the protruding portion 54 is able to come into contact with the position change member 46. The protruding portion 54 includes a first contact portion 54*a* and a second contact portion 54*b*. The first contact portion 54*a* is located at the leading side (in FIG. 4, the left side) of the above-mentioned one transmission portion 51, which has the protruding portion 54. The second contact portion 54*b* is located at the base side of the above-mentioned one transmission portion 51. The protruding portion 54 moves in the width direction to come into contact with the position change member 46, and causes the position change member 46 to rotate in the direction B of the circumference of the shaft portion 47 by further moving while being in contact therewith.

Next, the position change member 46 will now be explained.

Figure 5:
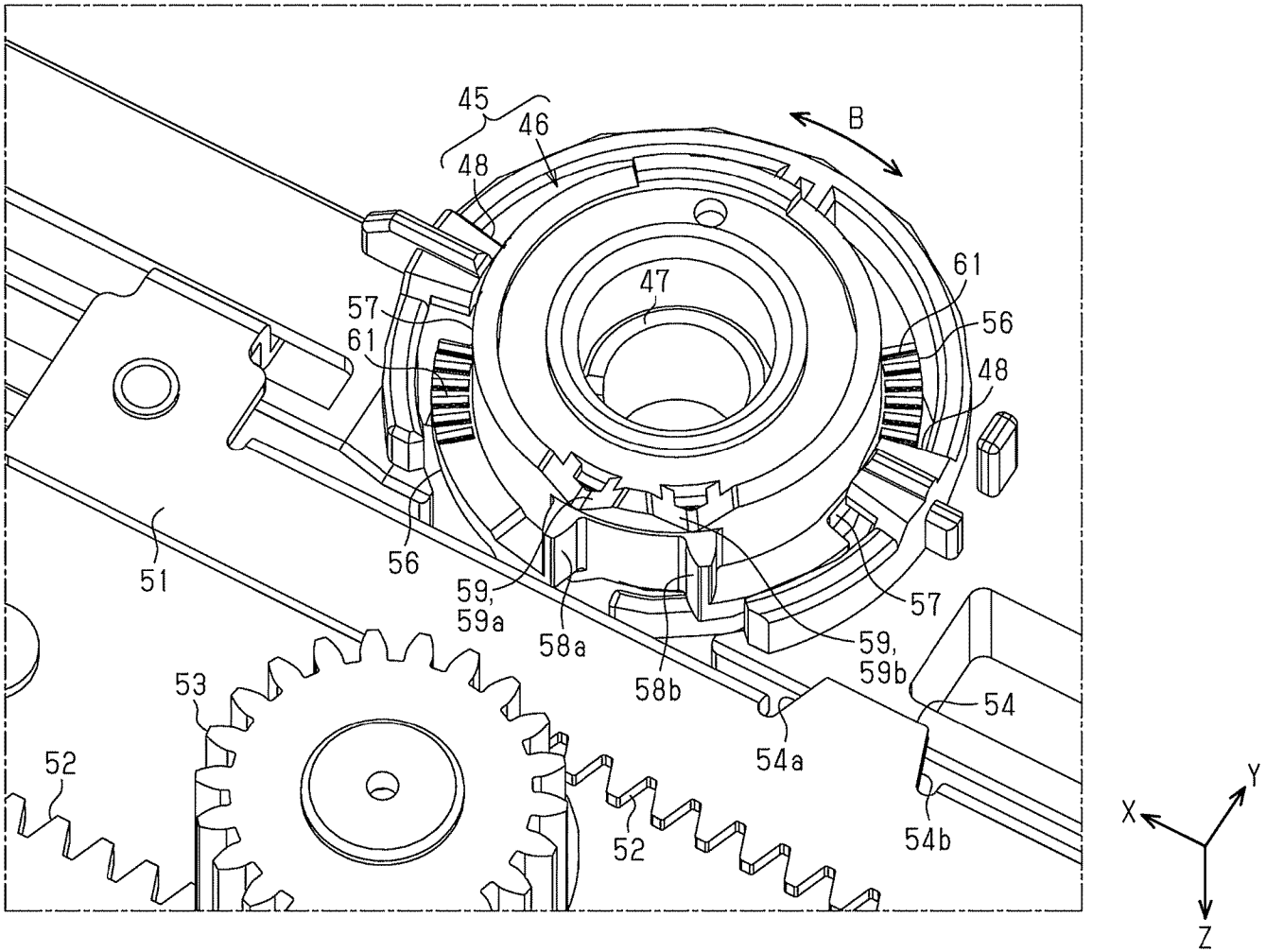
FIG. 5 is a perspective view of a switching portion and a protruding portion when in an urging state.
Figure 6:
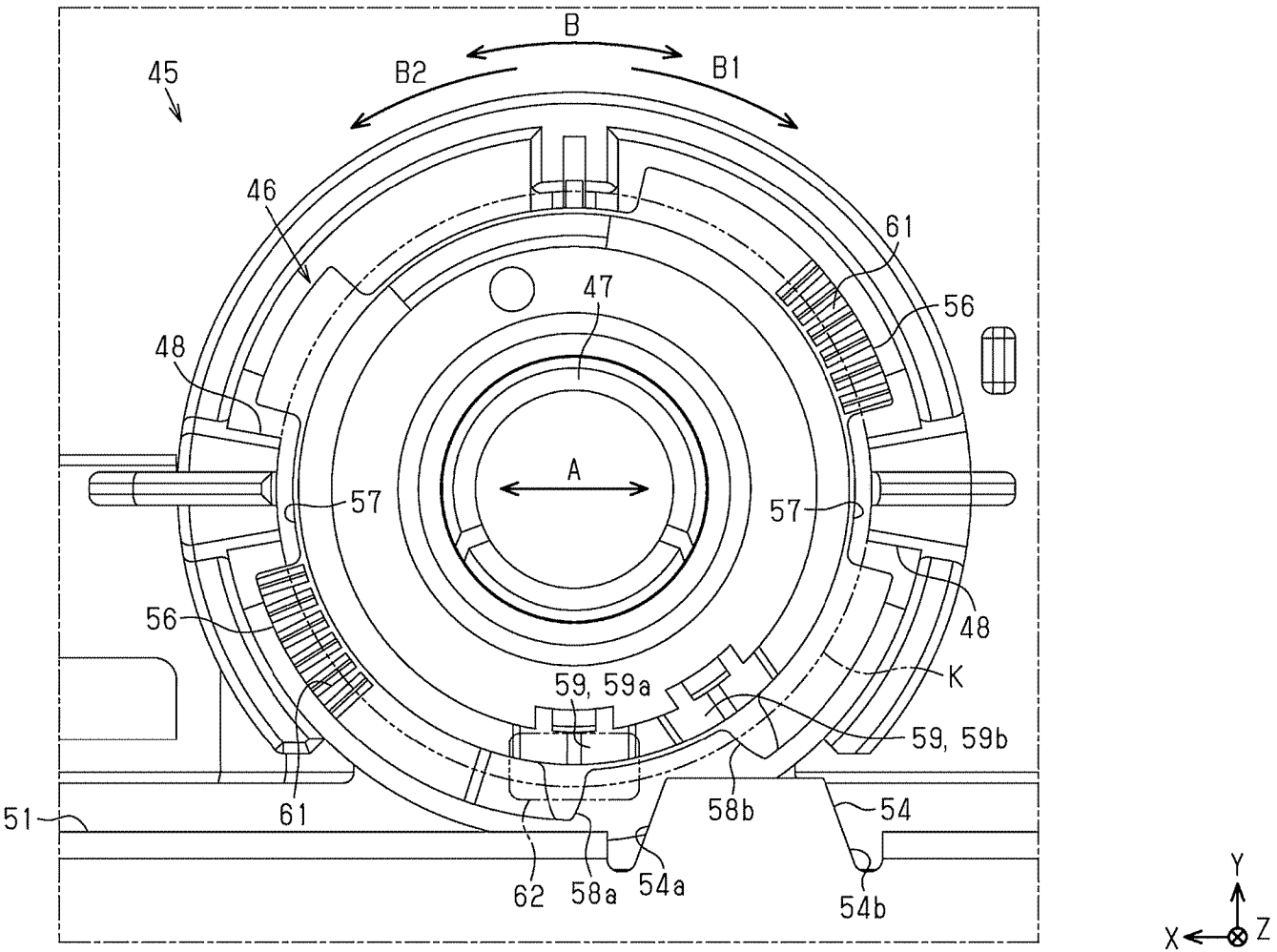
FIG. 6 is a plan view of the switching portion and the protruding portion when in an urging state.

As illustrated in FIGS. 5 and 6, the position change member 46 is partially protruding (56) outward in the radial direction A beyond a virtual circle K having its center at the shaft portion 47. In addition, as illustrated therein, the position change member 46 is partially recessed (57) inward in the radial direction A in such a way as not to go beyond the virtual circle K. The virtual circle K is concentric to the shaft portion 47 and goes through the head end of the restricting portion 48 (the end at the shaft-portion side 47). The recessed portion 57 has, in the circumferential direction B, a size that is large enough to pass through the restricting portion 48 in the vertical direction. Specifically, the position change member 46 has at least one extended portion 56 (in the present embodiment, two extensions) sticking out in the direction A of the diameter of the shaft portion 47 and at least one recessed portion 57 (in the present embodiment, two recesses) that is recessed inward in the radial direction A in relation to the at least one extended portion 56. The extended portion 56 and the recessed portion 57 are formed adjacent to each other on and in the side of the position change member 46. The position change member 46 has a third contact portion 58*a* and a fourth contact portion 58*b* on its side and a pair of concave portions 59 in its top. The third contact portion 58*a* and the fourth contact portion 58*b* are configured to be able to come into contact with the protruding portion 54. The pair of concave portions 59 includes a first concave portion 59*a* and a second concave portion 59*b* arranged adjacent to each other in the direction of rotation of the position change member 46 (the circumferential direction B).

In a case where the two guide portions 40 are moved relatively to each other in such a way as to decrease the distance therebetween in the width direction, the first contact portion 54*a* comes into contact with the third contact portion 58*a*. In a case where the two guide portions 40 are moved relatively to each other in such a way as to increase the distance therebetween in the width direction, the second contact portion 54*b* comes into contact with the fourth contact portion 58*b*.

Figure 7:
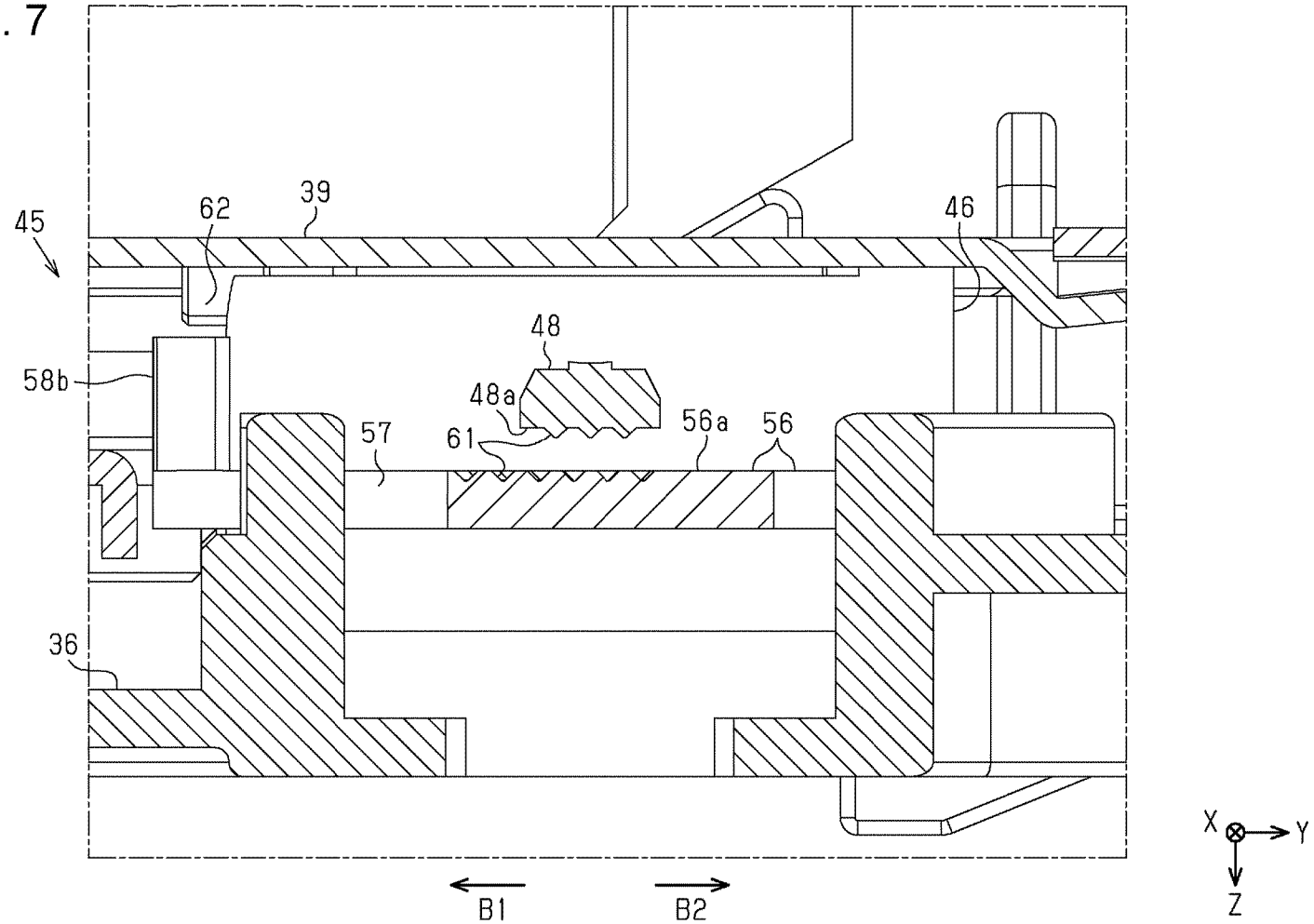
FIG. 7 is a sectional view of a restricting portion and an extended portion located thereunder.

As illustrated in FIG. 7, the extended portion 56 has a fifth contact portion 56*a* facing the hopper 39 from the bottom-plate side 36. The restricting portion 48 has a sixth contact portion 48*a*, with which the fifth contact portion 56*a* is able to come into contact from the bottom-plate side 36. At least one (in the present embodiment, both) of the fifth contact portion 56*a* and the sixth contact portion 48*a* has a non-slip structure 61 for preventing the fifth contact portion 56*a* and the sixth contact portion 48*a* from slipping in relation to each other when the fifth contact portion 56*a* and the sixth contact portion 48*a* are in contact with each other. The non-slip structure 61 of the present embodiment is a plurality of grooves formed in the radial direction A in the surface of the extended portion 56 and the surface of the restricting portion 48 facing each other. Due to the engagement of the grooves, the non-slip structure 61 enhances the force of friction acting between the extended portion 56 and the restricting portion 48. Utilizing the rotation of the position change member 46, the switching portion 45 performs switching between an urging state, in which the position change member 46 is not in contact with the restricting portion 48, and a non-urging state, in which the position change member 46 is in contact with the restricting portion 48. When the position change member 46 rotates, the first urging member 42*a* is switched to a non-urging state in a case where the fifth contact portion 56*a* is at a position of coming into contact with the sixth contact portion 48*a* from the bottom-plate side 36 or to an urging state in a case where the restricting portion 48 allows the recessed portion 57 to pass thereat.

Figure 8:
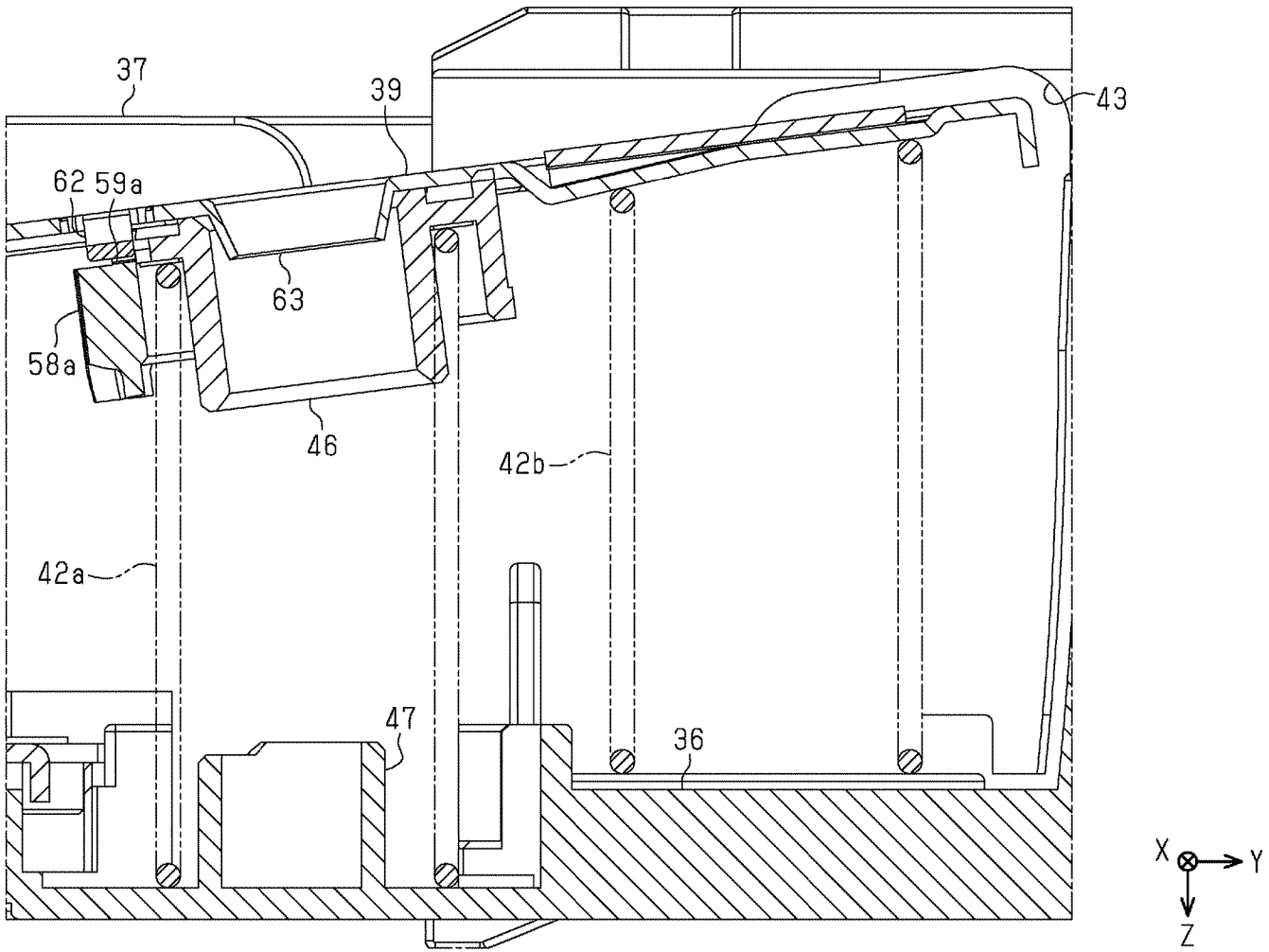
FIG. 8 is a sectional view of the switching portion and the hopper when in an urging state.
Figure 9:
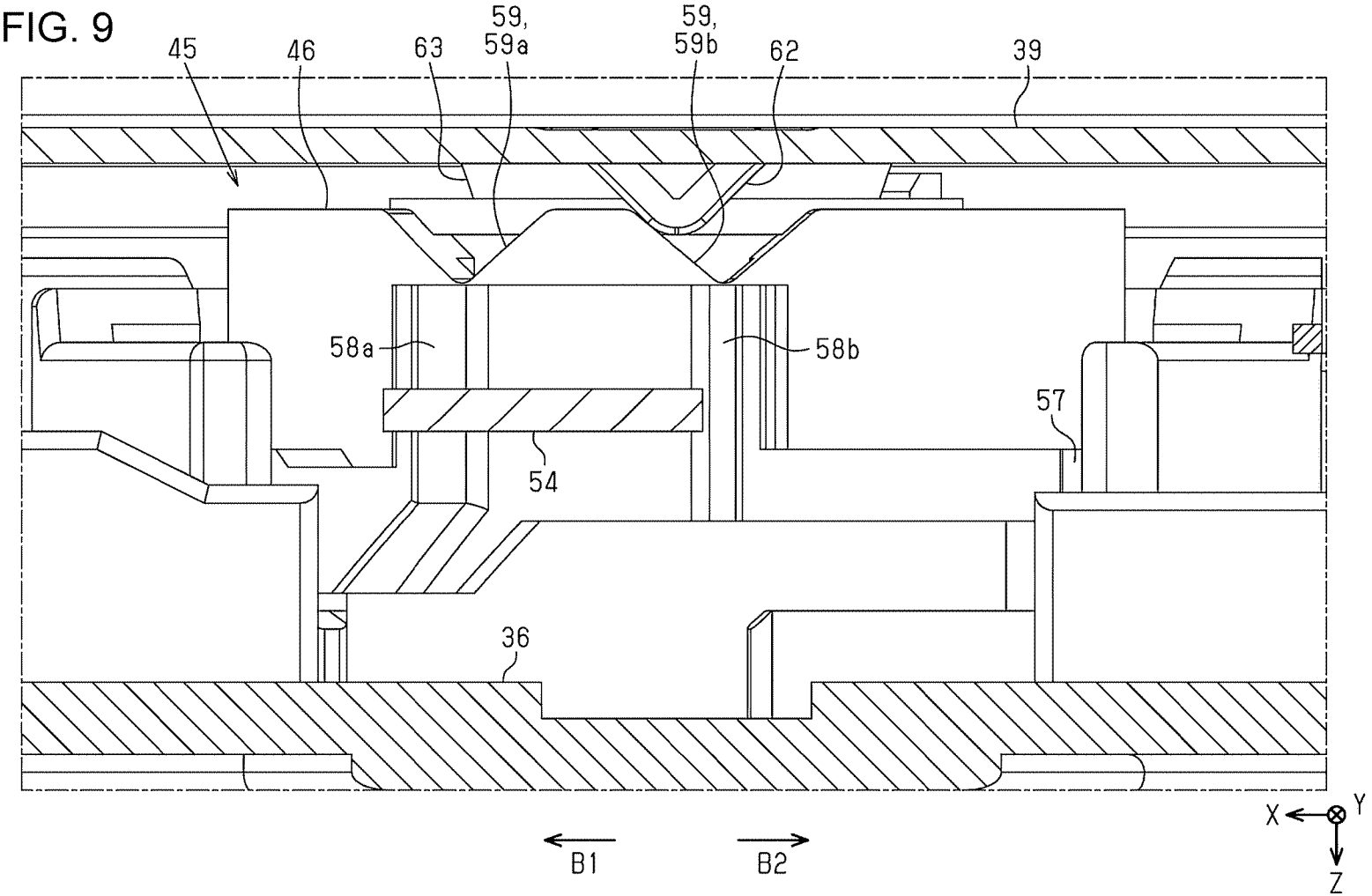
FIG. 9 is a front view of the switching portion when the position change member rotates in a first direction.

As illustrated in FIGS. 8 and 9, the hopper 39 has a convex portion 62 protruding toward the position change member 46. The convex portion 62 has a substantially triangular shape in frontal view. The convex portion 62 is able to come into engagement with the first concave portion 59*a* and is able to come into engagement with the second concave portion 59*b*. Each of the first concave portion 59*a* and the second concave portion 59*b* is a substantially triangular recess formed in the position change member 46. That is, either the hopper 39 or the position change member 46 has a convex portion 62 protruding toward the other, and the other has a concave portion(s) 59 that is able to come into engagement with the convex portion 62. Each of the convex portion 62 and the concave portion 59 has a slope. When the convex portion 62 and the concave portion 59 are in a state of imperfect engagement with each other, the slopes slide relatively to each other to cause the position change member 46 to rotate in a direction of bringing the state of imperfect engagement into perfection on the basis of the urging force of the first urging member 42*a*.

Figure 11:
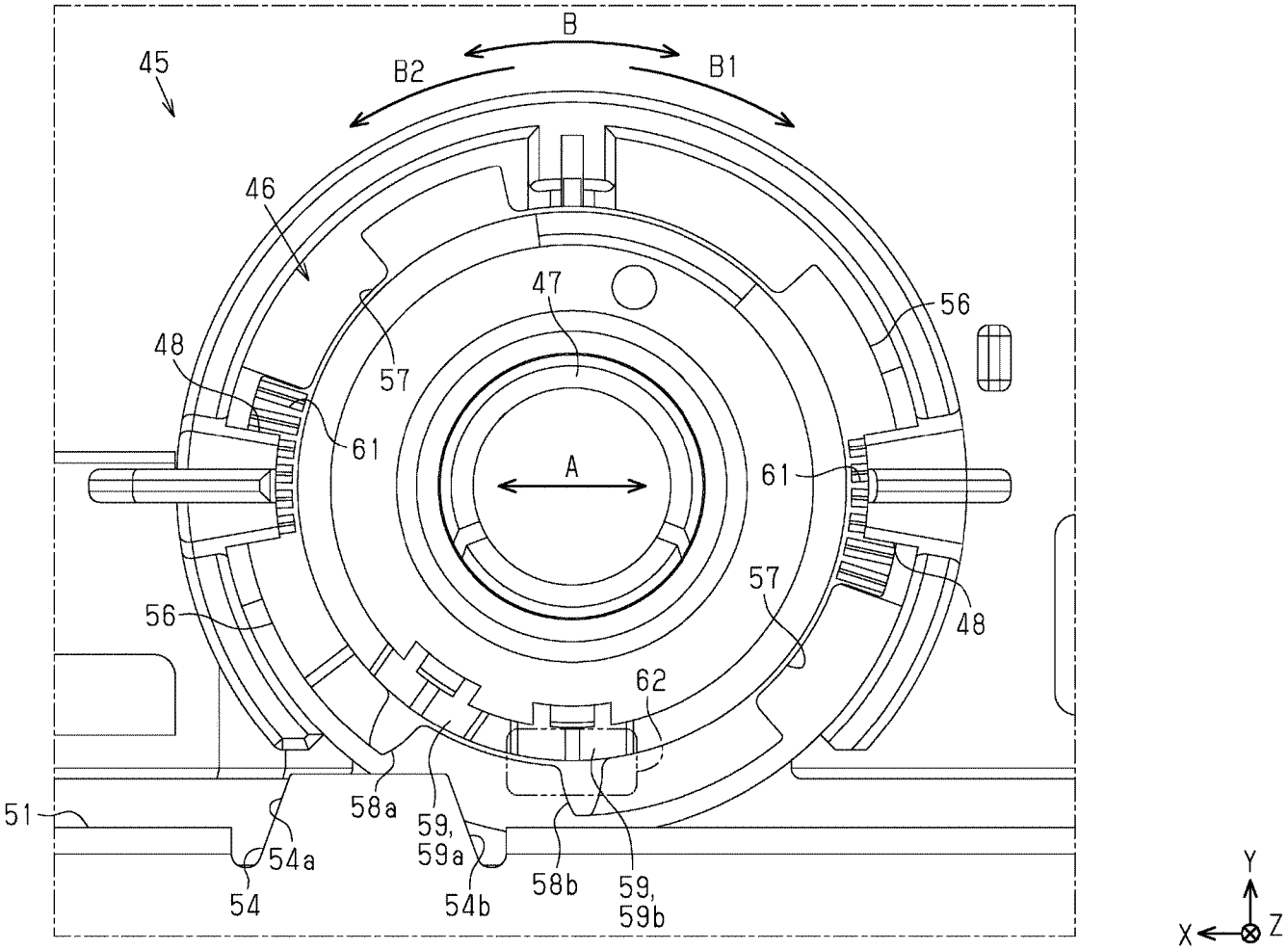
FIG. 11 is a plan view of the switching portion and the protruding portion when in a non-urging state.

The convex portion 62 is engaged with the second concave portion 59*b* when the first urging member 42*a* is in a non-urging state and when the position change member 46 is in contact with the restricting portion 48 from the bottom-plate side 36 (see FIG. 11). The convex portion 62 is engaged with the first concave portion 59*a* when the first urging member 42*a* is in an urging state and when the position change member 46 is in contact with the hopper 39 from the bottom-plate side 36 (see FIG. 6).

The hopper 39 has a holding portion 63, which is capable of holding the position change member 46 that is in contact from the bottom-plate side 36. The holding portion 63 has a substantially cylindrical shape with a smaller diameter in comparison with the position change member 46. The holding portion 63 restricts the movement of the position change member 46 in the feed direction Y2 and the width direction by being engaged with the internal circumferential surface of the position change member 46.

Next, the operation of the sheet placement apparatus 16 will now be explained.

As illustrated in FIG. 3, to place sheets S into the sheet placement apparatus 16, the sheet placement apparatus 16 is drawn out of the apparatus body 12. When this is performed, the hopper 39 is pushed down against the urging force of the urging member 42, and the anchoring latch 44 anchors the pushed-down hopper 39. Then, the user places sheets S in a state in which the space between the pair of guide portions 40 is wide, and moves the pair of guide portions 40 closer to each other for adjustment in accordance with the width of the sheets S.

As illustrated in FIGS. 4 and 6, in a case where the two guide portions 40 are located at the respective two ends in the width direction or a case where a sheet S that is large in width-directional size (for example, B5 or larger) is guided, the edge guide 50 and the protruding portion 54 are located on the same side (in FIG. 4, on the right side) in the width direction in relation to the position change member 46 (the third contact portion 58*a*). At this time, the convex portion 62 is engaged with the first concave portion 59*a*, and the restricting portion 48 is located at the recessed portion 57 so as to allow the position change member 46 to move upward (urging state).

As illustrated in FIG. 8, the position change member 46 that is in an urging state is pressed against the hopper 39 due to the urging force of the first urging member 42*a*. Therefore, when the sheet placement apparatus 16 is attached to the apparatus body 12 to release the hopper 38 from the anchoring by the anchoring latch 44, the position change member 46 moves in a turning direction (which is roughly along the gravity direction) around the supporting shaft 41 (see FIG. 3) to follow the turning of the hopper 39 while being held by the holding portion 63. When this is performed, since the first concave portion 59*a* of the position change member 46 is engaged with the convex portion 62, the rotation of the position change member 46 is restricted.

Next, a case where sheets S that are small in width-directional size (for example, A5 or smaller) are placed will now be explained. In the present embodiment, the switching of the function of the first urging member 42*a* is performed at a size between B5 and A5, and the size of sheets S available for use includes not only standard size but also non-standard size.

Figure 10:
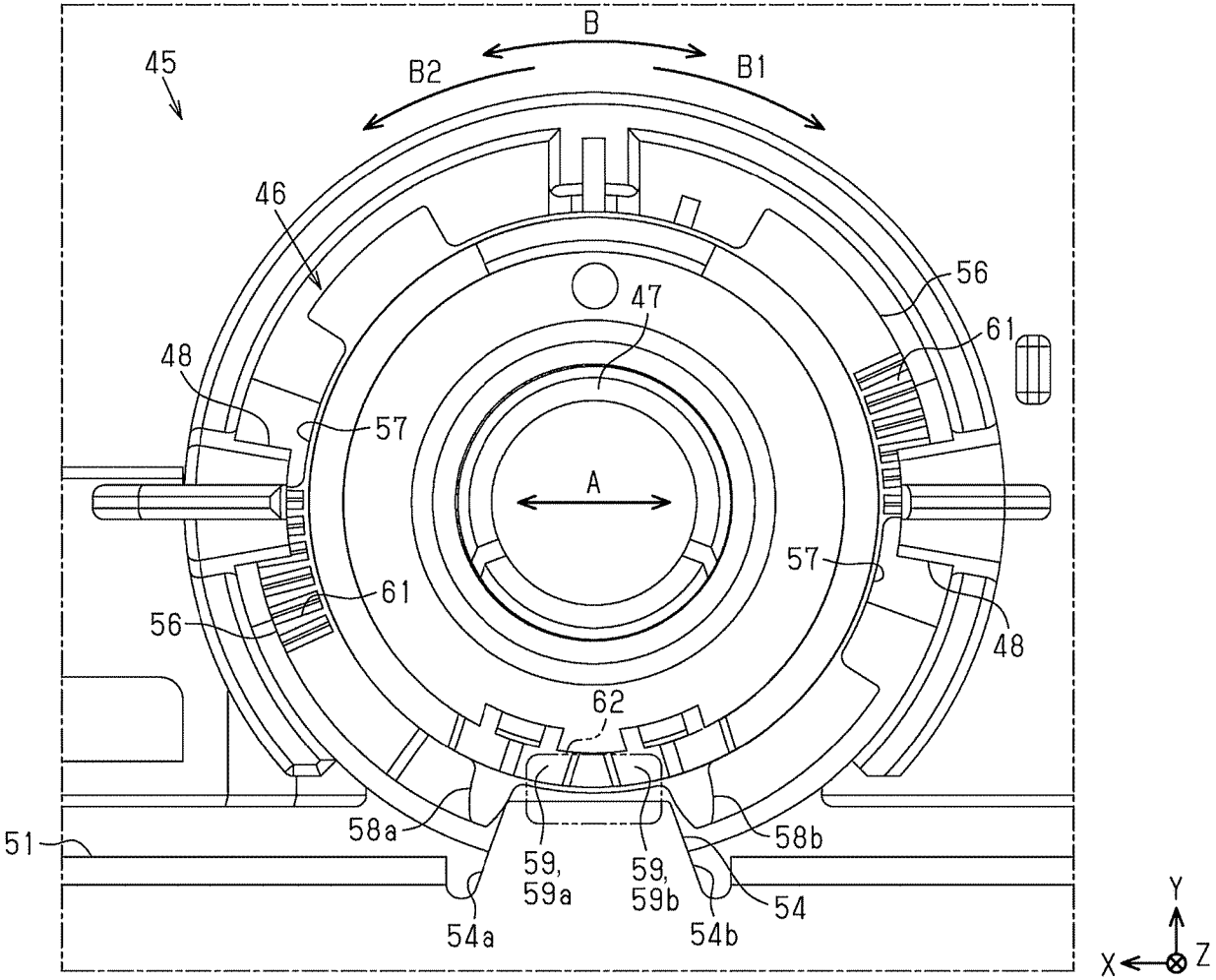
FIG. 10 is a plan view of the switching portion and the protruding portion.

As illustrated in FIG. 10, the first contact portion 54*a* of the protruding portion 54 comes into contact with the third contact portion 58*a* of the position change member 46 when the two guide portions 40 are moved closer to each other for adjustment in accordance with the width of the sheets S. When the guide portions 40 are further moved, the third contact portion 58*a* is pushed by the first contact portion 54*a*. Accordingly, the position change member 46 rotates in a first direction B1 (in the present embodiment, the clockwise direction). When this is performed, the convex portion 62 slides along the first concave portion 59 to climb up onto the top surface of the position change member 46, and causes the position change member 46 to move away from the hopper 39 against the urging force of the first urging member 42*a*.

That is, as illustrated in FIG. 7, the position change member 46 rotates while moving toward the bottom plate 36 to produce a state in which the extended portion 56 and the restricting portion 48 are away from each other. As explained above, when the first urging member 42*a* is in an urging state and when the position change member 46 is in contact with the hopper 39 from the bottom-plate side 36, the hopper 39 is able to cause the position change member 46 to move to the side closer to the bottom plate 36 (away from the hopper 39) than the restricting portion 48 by producing downward movement against the urging force of the first urging member 42*a*. The hopper 39 of the present embodiment causes the extended portion 56, which is a part of the position change member 46, to move to the side closer to the bottom plate 36 than the restricting portion 48. Then, the guide portions 40 move in the width direction in a state in which the extended portion 56 of the position change member 46 is located closer to the bottom plate 36 than the restricting portion 48.

As illustrated in FIG. 9, when the apex (bottom end) of the convex portion 62 arrives at a position of starting to enter the second concave portion 59*b*, due to the urging force of the first urging member 42*a* configured to urge the position change member 46 toward the hopper 39, the slope of the convex portion 62 and the slope of the second concave portion 59*b* slide relatively to each other to cause the position change member 46 to rotate in the first direction B1.

Figure 12:
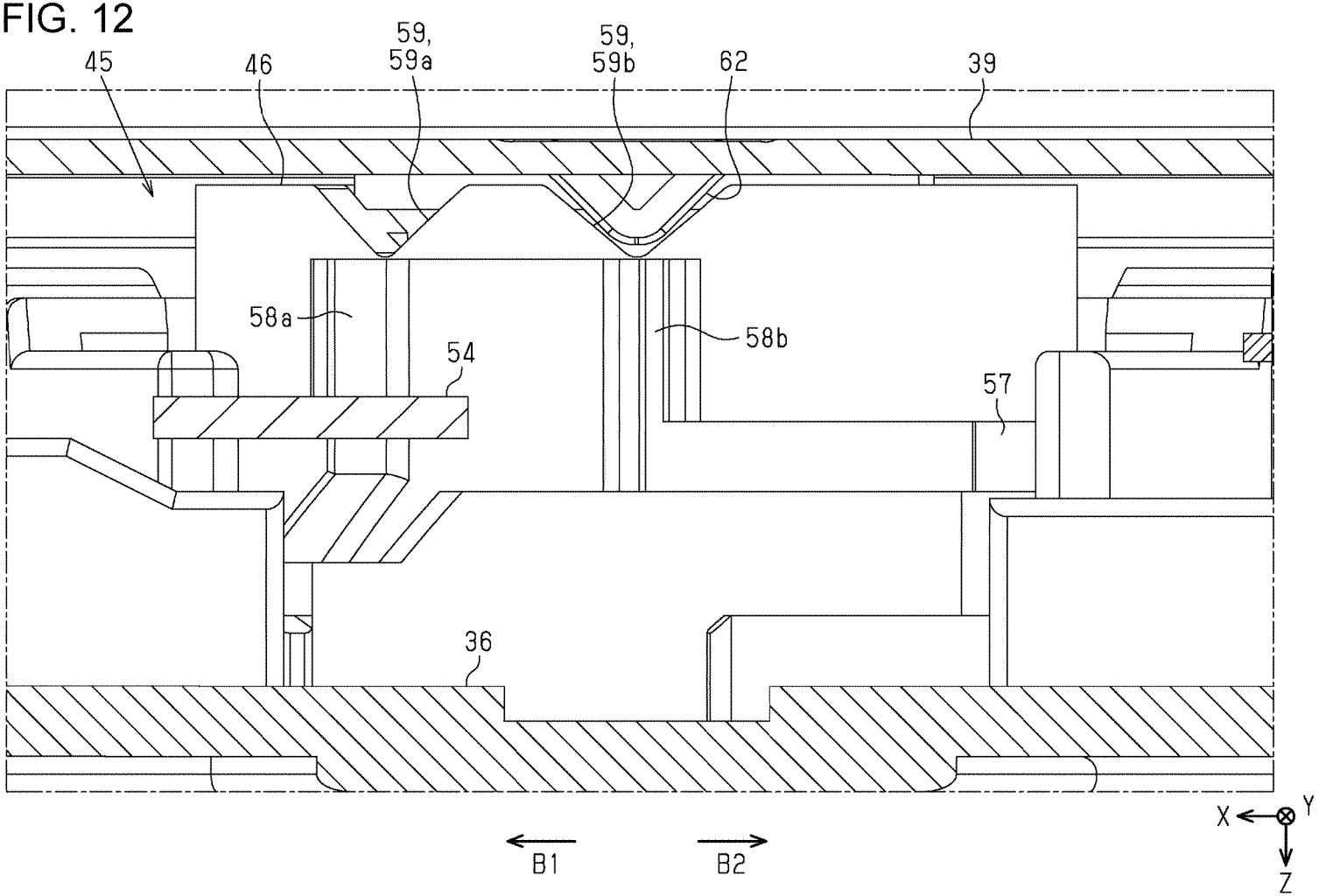
FIG. 12 is a front view of the switching portion when in a non-urging state.

As illustrated in FIGS. 11 and 12, when the pair of edge guides 50 is located at the position along the sheets S, the fourth contact portion 58*b* of the position change member 46 is located at a position between the protruding portion 54 and the edge guide 50. In addition, the convex portion 62 is engaged with the second concave portion 59*b*.

Figure 13:
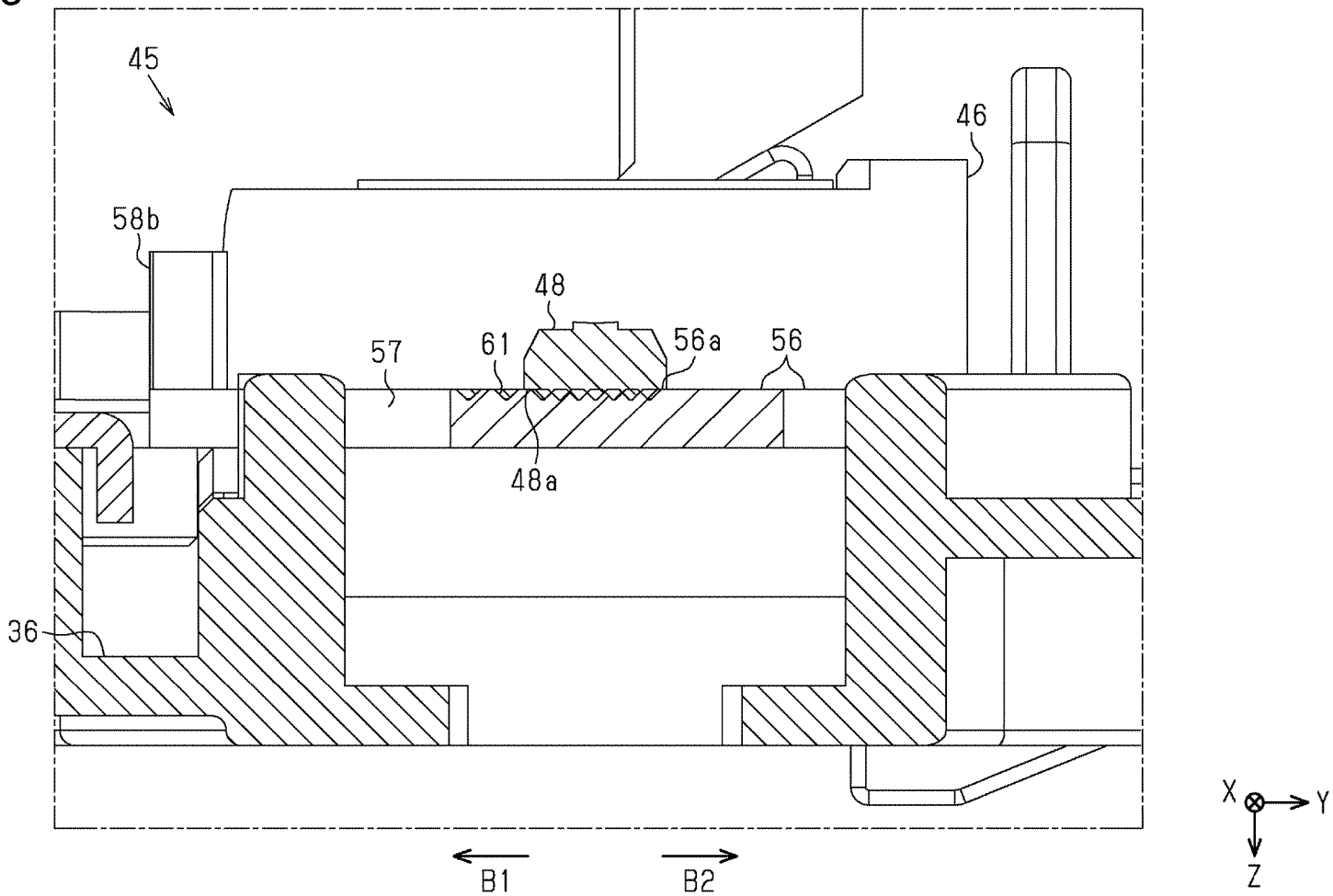
FIG. 13 is a sectional view of a state of engagement of the extended portion with the restricting portion.

As illustrated in FIGS. 11 and 13, the restricting portion 48 is engaged with the extended portion 56 and restricts the upward movement of the position change member 46 (non-urging state). As explained above, the position change member 46 gives rise to switching from an urging state to a non-urging state when the two guide portions 40 are moved in such a way as to make the space therebetween narrower in the width direction.

Figure 14:
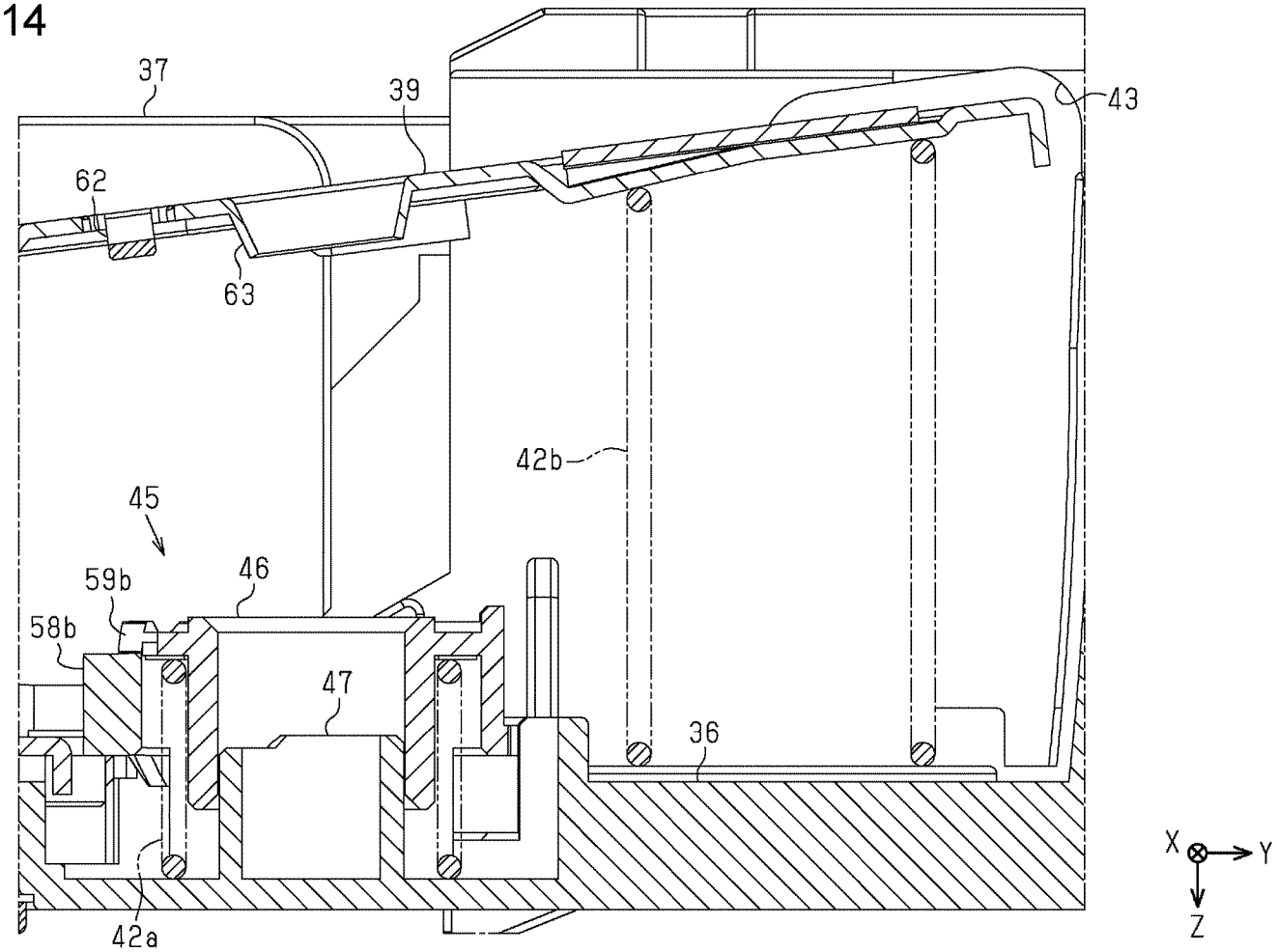
FIG. 14 is a sectional view of the switching portion and the hopper when in a non-urging state.

As illustrated in FIG. 14, the anchoring latch 44 releases the hopper 38 when the sheet placement apparatus 16 is attached to the apparatus body 12. The movement of the position change member 46 is restricted by the restricting portion 48 when in a non-urging state. Therefore, the position change member 46 stays at the position at the bottom-plate side 36 when the hopper 39 goes up, and the urging force of the first urging member 42*a* is not applied to the hopper 39. Therefore, the urging force that the hopper 39 receives when in a non-urging state is smaller than the urging force that the hopper 39 receives when in an urging state.

As illustrated in FIG. 11, in a case where the two guide portions 40 are moved away from each other from a non-urging state, the protruding portion 54 pushes the fourth contact portion 58*b* to cause the position change member 46 to rotate in a second direction B2 (in the present embodiment, the counterclockwise direction), which is the opposite of the first direction B1. The rotation in the second direction B2 brings the convex portion 62, which was engaged with the second concave portion 59*b*, into engagement with the first concave portion 59*a*, and brings the recessed portion 57 to the position of the restricting portion 48. That is, the position change member 46 gives rise to switching from a non-urging state to an urging state when the two guide portions 40 are moved in such a way as to make the space therebetween wider in the width direction.

Utilizing the rotation of the position change member 46 on the shaft portion 47, the switching portion 45 performs switching as described above between an urging state, in which the position change member 46 is not in contact with the restricting portion 48, and a non-urging state, in which the position change member 46 is in contact with the restricting portion 48. Specifically, the pushing contact of the first contact portion 54*a* with the third contact portion 58*a* causes the position change member 46 of the switching portion 45 to rotate in the first direction B1, thereby switching the state of the first urging member 42*a* from an urging state to a non-urging state. The pushing contact of the second contact portion 54*a* with the fourth contact portion 58*b* causes the position change member 46 of the switching portion 45 to rotate in the second direction B2, thereby switching the state of the first urging member 42*a* from a non-urging state to an urging state. The position change member 46 rotates when driven by the relative movement of the pair of guide portions 40 in the width direction. The state of the first urging member 42*a* is switched from an urging state to a non-urging state in a case where the two guide portions 40 are moved relatively to each other in such a way as to decrease the distance therebetween in the width direction.

The exemplary embodiment described above produces the following effects.

(1) The switching portion 45 realizes switching between an urging state, in which the hopper 39 is urged, and a non-urging state, in which the hopper 39 is not urged, without requiring a space for sliding movement, by causing either one, the position change member 46 or the restricting portion 48, to rotate on the shaft portion 47 between a contact position where the one is in contact with the other and a non-contact position where the one is not in contact with the other. Therefore, it is possible to change the force of urging the hopper 39 configured to push up sheets S without an increase in size.

(2) When the space between the pair of guide portions 40 is decreased in accordance with sheets S that are small in size in the width direction, among the plurality of urging members 42 provided at respective positions in the width direction, the state of the first urging member 42*a*, which is provided at the center area, is switched from an urging state to a non-urging state. Therefore, it is possible to make the force of urging the hopper 39 smaller when sheets S that are small in size are placed.

(3) When the two guide portions 40 are moved relatively to each other in such a way as to decrease the distance therebetween in the width direction, the first contact portion 54*a* of the protruding portion 54, which protrudes from the transmission portion 51 toward the switching portion 45, comes into contact with the third contact portion 58*a* of the switching portion 45 to cause either the position change member 46 or the restricting portion 48 to rotate in the first direction B1, thereby switching the state of the first urging member 42*a* to a non-urging state. When the two guide portions 40 are moved relatively to each other in such a way as to increase the distance therebetween in the width direction, the second contact portion 54*b* of the protruding portion 54, which protrudes from the transmission portion 51 toward the switching portion 45, comes into contact with the fourth contact portion 58*b* of the switching portion 45 to cause either the position change member 46 or the restricting portion 48 to rotate in the second direction B2, thereby switching the state of the first urging member 42*a* to an urging state. Therefore, it is possible to easily switch the state of the first urging member 42*a* configured to urge the hopper 39 between an urging state and a non-urging state by moving the guide portions 40 relatively to each other in accordance with the size of sheets S placed.

(4) The switching portion 45 is able to put the first urging member 42*a* into a non-urging state by causing either one, the position change member 46 or the restricting portion 48, to rotate so as to bring the fifth contact portion 56*a* of the extended portion 56 of the position change member 46 into contact with the sixth contact portion 48*a* of the restricting portion 48 from the bottom-plate side 36, and is able to put the first urging member 42*a* into an urging state by rotation to a position where the restricting portion 48 allows the recessed portion 57 of the position change member 46 to pass. Therefore, it is possible to easily switch the state of the first urging member 42*a* configured to urge the hopper 39 between an urging state and a non-urging state by causing either the position change member 46 or the restricting portion 48 to rotate.

(5) It is possible to make the fifth contact portion 56*a* and the sixth contact portion 48*a* less slippery in relation to each other when the fifth contact portion 56*a* of the extended portion 56 of the position change member 46 is in contact with the sixth contact portion 48*a* of the restricting portion 48 from the bottom-plate side 36 and when the first urging member 42*a* is therefore in a non-urging state. Therefore, it is possible to reduce the risk that the fifth contact portion 56*a* and the sixth contact portion 48*a* might be brought out of contact with each other due to the effect of, for example, vibration.

(6) For example, in a case where the first urging member 42*a* is in a non-urging state and where the position change member 46 is in contact with the restricting portion 48, when the guide portions 40 are moved from this state to cause either the position change member 46 or the restricting portion 48 to rotate, the position change member 46 is pushed down by the hopper 39 away from the restricting portion 48. Therefore, it is possible to easily switch the state of the first urging member 42*a* configured to urge the hopper 39 between an urging state and a non-urging state by performing an operation of moving the guide portions 40.

(7) In a structure of switching the state of the first urging member 42*a* between an urging state and a non-urging state by means of the rotation of the position change member 46 of the switching portion 45, the rotation phase of the position change member 46 is properly kept due to engagement of the convex portion 62, which either the hopper 39 or the position change member 46 has, and the concave portion 59, which the other of the two has. If the convex portion 62 of the one and the concave portion 59 of the other are in a state of imperfect engagement with each other, there is a risk that the imperfection might disrupt the rotation phase of the position change member 46. Such a risk should be avoided. In this respect, when the convex portion 62 and the concave portion 59 are in a state of imperfect engagement with each other, the slope of the convex portion 62 and the slope of the concave portion 59 slide relatively to each other to cause the position change member 46 to rotate in a direction of bringing the state of imperfect engagement into perfection by means of the urging force of the first urging member 42*a*. It is possible to put the first urging member 42*a* into a non-urging state, with the contact of the position change member 46 with the restricting portion 48, in a case where the convex portion 62 comes into engagement with the second concave portion 59*b*. It is possible to put the first urging member 42*a* into an urging state and urge the hopper 39 in a case where the convex portion 62 comes into engagement with the first concave portion 59*a*.

(8) Since the holding portion 63 of the hopper 39 restricts the movement of the position change member 46 of the switching portion 45 in the feed direction Y2 and the width direction, it is possible to make the change in position of the position change member 46 stable in the direction of urging by the first urging member 42*a*.

The exemplary embodiment described above may be modified as described in variation examples below. The exemplary embodiment described above may be combined with any of the variation examples below.

The feeder unit 21 does not necessarily have to include the separation rollers 26. For example, the sheet placement apparatus 16 may be a manual-feed tray on which a single sheet S could be placed. The sheet placement apparatus 16 may be fixed to the apparatus body 12.

The separation rollers 26 may be replaced with a separation pad that utilizes a force of friction with a sheet S for sheet separation. The feeder unit 21 may be provided with a belt instead of the pickup roller 25 to feed a sheet S. The transportation unit 22 may be provided with a belt instead of the pairs of transportation rollers 27 to transport a sheet S.

Any alternative structure may be adopted for the holding portion 63 as long as it is capable of holding the position change member 46. For example, the holding portion 63 may clamp and hold the position change member 46 from the outside in the radial direction A. The hopper 39 does not necessarily have to include the holding portion 63.

The position change member 46 may include either the first concave portion 59*a* or the second concave portion 59*b* as the concave portion 59, instead of both.

The hopper 39 may include the concave portion 59, and the position change member 46 may include the convex portion 62.

The hopper 39 and the position change member 46 do not necessarily have to include the convex portion 62 and the concave portion 59.

The convex portion 62 may be provided on both of the hopper 39 and the position change member 46, without any concave portion 59. In a case where the convex portion 62 is provided on the position change member 46, preferably, the convex portion 62 should be made up of the second-concave-portion-side (59*b*) slope of the first concave portion 59*a* and the first-concave-portion-side (59*a*) slope of the second concave portion 59*b*. That is, the top surface of the position change member 46 may coincide with the bottom of the first concave portion 59*a* and the second concave portion 59*b*. Either one of the convex portion 62 provided on the hopper 39 and the convex portion 62 provided on the position change member 46, or either one of the convex portion 62 and the concave portion 59, may have a slope, and the other may slide along the slope.

It suffices if at least one of the extended portion 56 and the restricting portion 48 has the non-slip structure 61. Any alternative structure may be adopted for the non-slip structure 61 as long as it increases the force of friction between the extended portion 56 and the restricting portion 48. For example, it may be a rough surface.

The sheet placement apparatus 16 may have a single guide portion 40 having the protruding portion 54.

The sheet placement apparatus 16 does not necessarily have to include the protruding portion 54. For example, the position change member 46 may be provided with a gear that is in meshing engagement with the rack 52, and the rotation of the position change member 46 may be driven by the movement of the guide portions 40.

The sheet placement apparatus 16 does not necessarily have to include the guide portion 40. For example, the hopper 39 may have a slit or the like, and the position change member 46 exposed through the slit or the like may be rotated by a user. The position change member 46 may be configured to rotate regardless of the position of the guide portion 40. The position change member 46 may be configured for switching between an urging state and a non-urging state depending on, for example, the type of the sheet S (e.g., sheet stiffness, the force of friction between the sheets S).

The position change member 46 may be configured to be able to rotate either in the first direction B1 or the second direction B2 only, switching between an urging state and a non-urging state may depend on phase.

The sheet placement apparatus 16 may include one or two urging members 42. The sheet placement apparatus 16 may include four or more urging members 42. The position change member 46 may be provided on at least one urging member 42 among a plurality of urging members 42.

The switching portion 45 may be configured such that the restricting portion 48 is rotatable. In this case, the concave portion 59 or the convex portion 62 may be provided on the restricting portion 48.

The sheet S may be paper, resin sheet, a composite of paper and resin (resin-impregnated paper, resin-coated paper, etc.), metal, a composite of resin and metal, woven fabric, nonwoven fabric, ceramic sheet, or the like.

The sheet placement apparatus 16 may be provided on a scanner for scanning an image on a sheet S (document), a folding machine for folding a sheet S (e.g., paper folding machine), a shredder for shredding a sheet S, or the like.

The printing apparatus 11 is an apparatus that prints characters and/or an image such as a picture or a photo by ejecting liquid such as ink or fluid such as toner onto a sheet S. For example, the printing apparatus 11 may be a serial printer, a lateral printer, a line printer, or a page printer. The printing apparatus 11 may be an offset printer or a textile printer, etc.

What is claimed is:

1. A sheet placement apparatus, comprising:

a placement portion on which a sheet is able to be placed;

a hopper that pushes up the sheet off a bottom of the placement portion by moving away from the bottom inside the placement portion;

a pushing member that pushes the hopper away from the bottom;

a switching portion that switches the pushing member between a pushing state, in which the hopper is pushed, and a non-pushing state, in which the hopper is not pushed, the switching portion including:

a position change member that is fixed to the pushing member in such a way as to be able to change position due to deformation of the pushing member, is in contact with the hopper from a bottom side when the pushing member is in the pushing state, and is located away from the hopper toward the bottom when the pushing member is in the non-pushing state, and a restricting portion that is provided at a position that is, in the placement portion, closer to the bottom than the hopper is and is on a path of position change of the position change member, is configured to allow the position change member to change position toward the hopper on a basis of a pushing force of the pushing member when the position change member is not in contact with the restricting portion, and is configured to restrict position change of the position change member toward the hopper against the pushing force of the pushing member when the position change member is in contact with the restricting portion;

wherein either one, the position change member or the restricting portion, is able to rotate relatively to the other on a shaft portion, which intersects with the bottom in a vertical direction, the position change member and the shaft portion being coaxial in the non-pushing state, and wherein rotation of the either one causes a switching between the pushing state, in which the position change member is not in contact with the restricting portion, and the non-pushing state, in which the position change member is in contact with the restricting portion.

2. The sheet placement apparatus according to claim 1, wherein, on the placement portion, a pair of guide portions for determining a position of the placed sheet in a width direction intersecting with a feed direction, in which the sheet is fed from the placement portion, is provided in such a way as to be able to move in relation to each other in the width direction, the pushing member being one of a plurality of pushing members, and each one pushing member included the plurality of pushing members is provided at a corresponding position in the width direction;

wherein the switching portion is able to switch, among the plurality of pushing members, the pushing member that is provided at a center area in the width direction between the pushing state and the non-pushing state;

wherein the either one of the position change member and the restricting portion rotates when driven by relative movement of the pair of guide portions in the width direction; and wherein the pushing member is switched from the pushing state to the non-pushing state in a case where the pair of guide portions is moved relatively to each other in such a way as to decrease a distance therebetween in the width direction.

3. The sheet placement apparatus according to claim 2, wherein each of the pair of guide portions includes a transmission portion that extends toward the center in the width direction;

wherein each of the transmission portions has a rack that is in meshing engagement with a pinion provided at the center area in the width direction, with the pinion engaged between the respective transmission portions of the pair of guide portions;

wherein, as one of the two transmission portions of the pair of guide portions, a transmission portion that is located at a position closer to the switching portion has a protruding portion that protrudes toward the switching portion at an opposite side that is opposite of a side that has the rack;

wherein the protruding portion includes a first contact portion, which is located at a leading side of the one transmission portion on which the protruding portion is formed, and a second contact portion, which is located at a base side of the one transmission portion;

wherein the switching portion includes a third contact portion, with which the first contact portion comes into contact in a case where the pair of guide portions is moved relatively to each other in such a way as to decrease the distance therebetween in the width direction, and a fourth contact portion, with which the second contact portion comes into contact in a case where the pair of guide portions is moved relatively to each other in such a way as to increase the distance therebetween in the width direction;

wherein pushing contact of the first contact portion with the third contact portion causes the either one of the position change member and the restricting portion of the switching portion to rotate in a first direction, thereby switching the pushing member from the pushing state to the non-pushing state; and wherein pushing contact of the second contact portion with the fourth contact portion causes the either one of the position change member and the restricting portion of the switching portion to rotate in a second direction that is opposite of the first direction, thereby switching the pushing member from the non-pushing state to the pushing state.

4. The sheet placement apparatus according to claim 3, wherein the position change member has an extended portion, which protrudes outward in a radial direction beyond a virtual circle having the center at the shaft portion, and a recessed portion, which is recessed inward in the radial direction in such a way as not to go beyond the virtual circle, and the recessed portion has a size that is large enough to pass through the restricting portion;

wherein the extended portion has a fifth contact portion facing the hopper from the bottom side;

wherein the restricting portion has a sixth contact portion, with which the fifth contact portion is able to come into contact from the bottom side;

wherein, when the either one of the position change member and the restricting portion rotates, the pushing member is switched to the non-pushing state in a case where the fifth contact portion is at a position of coming into contact with the sixth contact portion from the bottom side or to the pushing state in a case where the restricting portion allows the recessed portion to pass thereat.

5. The sheet placement apparatus according to claim 4, wherein at least one of the fifth contact portion and the sixth contact portion has a non-slip structure for preventing the fifth contact portion and the sixth contact portion from slipping in relation to each other when the fifth contact portion and the sixth contact portion are in contact with each other.

6. The sheet placement apparatus according to claim 5, wherein, when the pushing member is in the pushing state and when the position change member is in contact with the hopper from the bottom side, the hopper is able to cause the position change member to move to the side closer to the bottom than the restricting portion by producing downward movement against the pushing force of the pushing member; and wherein the guide portions for determining the position of the sheet placed on the placement portion in the width direction intersecting with the feed direction, in which the sheet is fed from the placement portion, move in the width direction in a state in which the position change member is located closer to the bottom than the restricting portion.

7. The sheet placement apparatus according to claim 6, wherein, of the switching portion, which includes the position change member and the restricting portion, the restricting portion is provided in a fixed manner, and the position change member is able to rotate on the shaft portion;

wherein either the hopper or the position change member has a convex portion protruding toward the other, and the other has a pair of concave portions that is able to come into engagement with the convex portion;

wherein each of the convex portion and the concave portion has a slope, and, when the convex portion and the concave portion are in a state of imperfect engagement with each other, the slopes slide relatively to each other to cause the position change member to rotate in a direction of bringing the state of imperfect engagement into perfection on the basis of the pushing force of the pushing member;

wherein the pair of concave portions includes a first concave portion and a second concave portion arranged adjacent to each other in a direction of rotation of the position change member;

wherein the convex portion is engaged with the second concave portion when the pushing member is in the non-pushing state and when the position change member is in contact with the restricting portion from the bottom side; and wherein the convex portion is engaged with the first concave portion when the pushing member is in the pushing state and when the position change member is in contact with the hopper from the bottom side.

8. The sheet placement apparatus according to claim 7, wherein the hopper has a holding portion, which is capable of holding the position change member that is in contact from the bottom side; and wherein the holding portion restricts movement of the position change member in the feed direction and the width direction.

9. A printing apparatus, comprising:

the sheet placement apparatus according to claim 1;

a feeder unit that feeds the sheet placed in the sheet placement apparatus; and a printing unit that performs printing on the sheet.

10. A printing apparatus, comprising:

the sheet placement apparatus according to claim 2;

a feeder unit that feeds the sheet placed in the sheet placement apparatus; and a printing unit that performs printing on the sheet.

11. A printing apparatus, comprising:

the sheet placement apparatus according to claim 3;

a feeder unit that feeds the sheet placed in the sheet placement apparatus; and a printing unit that performs printing on the sheet.

12. A printing apparatus, comprising:

the sheet placement apparatus according to claim 4;

a feeder unit that feeds the sheet placed in the sheet placement apparatus; and a printing unit that performs printing on the sheet.

13. A printing apparatus, comprising:

the sheet placement apparatus according to claim 5;

a feeder unit that feeds the sheet placed in the sheet placement apparatus; and a printing unit that performs printing on the sheet.

14. A printing apparatus, comprising:

the sheet placement apparatus according to claim 6;

a feeder unit that feeds the sheet placed in the sheet placement apparatus; and a printing unit that performs printing on the sheet.

15. A printing apparatus, comprising:

the sheet placement apparatus according to claim 7;

a feeder unit that feeds the sheet placed in the sheet placement apparatus; and a printing unit that performs printing on the sheet.

16. A printing apparatus, comprising:

the sheet placement apparatus according to claim 8;

a feeder unit that feeds the sheet placed in the sheet placement apparatus; and a printing unit that performs printing on the sheet.

17. A sheet placement apparatus, comprising:

a placement portion on which a sheet is able to be placed;

a hopper that pushes up the sheet off a bottom of the placement portion by moving away from the bottom inside the placement portion;

a pushing member that pushes the hopper away from the bottom;

a switching portion that switches the pushing member between a pushing state, in which the hopper is pushed, and a non-pushing state, in which the hopper is not pushed, the switching portion including:

a position change member having a substantially cylindrical shape which is fixed to the pushing member in such a way as to be able to change position due to deformation of the pushing member, is in contact with the hopper from a bottom side when the pushing member is in the pushing state, and is located away from the hopper toward the bottom when the pushing member is in the non-pushing state, and a restricting portion that is provided at a position that is, in the placement portion, closer to the bottom than the hopper is and provided around the position change member on a path of position change of the position change member, is configured to allow the position change member to change position toward the hopper on a basis of a pushing force of the pushing member when the position change member is not in contact with the restricting portion, and is configured to restrict position change of the position change member toward the hopper against the pushing force of the pushing member when the position change member is in contact with the restricting portion;

wherein the position change member is able to rotate relatively to the restricting portion on a shaft portion, which intersects with the bottom in a vertical direction, and wherein rotation of the position change member causes a switching between the pushing state, in which the position change member is not in contact with the restricting portion, and the non-pushing state, in which the position change member is in contact with the restricting portion.

* * * * *